US007941885B2

(12) United States Patent
Wong et al.

(10) Patent No.: US 7,941,885 B2
(45) **Date of Patent: *May 17, 2011**

(54) STEAM WASHING MACHINE OPERATION METHOD HAVING DRY SPIN PRE-WASH

(75) Inventors: Nyik Siong Wong, Saint Joseph, MI (US); Raveendran Vaidhyanathan, Saint Joseph, MI (US); Anthony H. Hardaway, Stevensville, MI (US); Joel A. Luckman, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 815 days.

This patent is subject to a terminal disclaimer.

(21) Appl. No.: 11/450,620

(22) Filed: Jun. 9, 2006

(65) Prior Publication Data

US 2007/0283507 A1 Dec. 13, 2007

(51) Int. Cl.
*D06F 35/00* (2006.01)

(52) U.S. Cl. ..... 8/158; 68/12.01; 68/12.12; 68/12.19

(58) Field of Classification Search ..... 68/12.01, 68/12.12, 12.19, 12.23; 8/158
See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 0,647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,778,212 | A | 1/1957 | Dayton et al. |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |

(Continued)

FOREIGN PATENT DOCUMENTS

CA 1330526 C 7/1994

(Continued)

OTHER PUBLICATIONS

V-Zug LTD Washing Machine Adora SL; User Manual; V-Zug AG, CH-6301 Zug, 2004; V-Zug LTD Industriestrasse 66, 6301 Zug, Tel. 041 767 67 67.

*Primary Examiner* — Michael Barr
*Assistant Examiner* — Jason Heckert
(74) *Attorney, Agent, or Firm* — Clifton G. Green; McGarry Bair PC

(57) ABSTRACT

A method for operating a horizontal axis washing machine having a tub with a drum rotatably mounted in the tub and configured to hold a fabric load comprises introducing liquid into the drum to wet the fabric load and spinning the drum to distribute the fabric load about the drum prior to the introducing of the liquid.

15 Claims, 19 Drawing Sheets

U.S. PATENT DOCUMENTS

| | | | | |
|---|---|---|---|---|
| 3,060,713 | A | 10/1962 | Burkall | |
| 3,223,108 | A | 12/1965 | Martz, Jr | |
| 3,234,571 | A | 2/1966 | Buss | |
| 3,347,066 | A | 10/1967 | Klausner | |
| 3,498,091 | A | 3/1970 | Mason | |
| 3,550,170 | A | 12/1970 | Davis | |
| 3,697,727 | A | 10/1972 | Neuman et al. | |
| 3,707,855 | A | 1/1973 | Buckley | |
| 3,712,089 | A | 1/1973 | Toth | 68/210 |
| 3,801,077 | A | 4/1974 | Pearson | |
| 3,830,241 | A | 8/1974 | Dye et al. | |
| 3,869,815 | A | 3/1975 | Bullock | |
| 3,890,987 | A | 6/1975 | Marcussen et al. | |
| 3,935,719 | A | 2/1976 | Henderson | |
| 4,020,396 | A | 4/1977 | Gambale et al. | |
| 4,034,583 | A | 7/1977 | Miessler | 68/16 |
| 4,045,174 | A | 8/1977 | Fuhring et al. | |
| 4,108,000 | A | 8/1978 | Norris | |
| 4,177,928 | A | 12/1979 | Bergkvist | |
| 4,207,683 | A | 6/1980 | Horton | 34/60 |
| 4,214,148 | A | 7/1980 | Fleischauer | |
| 4,263,258 | A | 4/1981 | Kalasek | |
| 4,332,047 | A | 6/1982 | Kuttelwesch | 8/158 |
| 4,373,430 | A | 2/1983 | Allen | |
| 4,386,509 | A | 6/1983 | Kuttelwesch | 68/20 |
| 4,432,111 | A | 2/1984 | Hoffmann et al. | 8/158 |
| 4,489,574 | A | 12/1984 | Spendel | |
| 4,496,473 | A | 1/1985 | Sanderson | |
| 4,527,343 | A | 7/1985 | Danneberg | |
| 4,646,630 | A | 3/1987 | McCoy et al. | |
| 4,761,305 | A | 8/1988 | Ochiai | |
| 4,777,682 | A | 10/1988 | Dreher et al. | 8/158 |
| 4,784,666 | A | 11/1988 | Brenner et al. | 8/137 |
| 4,809,597 | A | 3/1989 | Lin | |
| 4,879,887 | A | 11/1989 | Kagi et al. | 68/16 |
| 4,920,668 | A | 5/1990 | Henneberger et al. | |
| 4,987,627 | A * | 1/1991 | Cur et al. | 8/158 |
| 4,991,545 | A | 2/1991 | Rabe et al. | |
| 5,032,186 | A | 7/1991 | Childers et al. | 134/25 |
| 5,050,259 | A | 9/1991 | Tsubaki et al. | 8/159 |
| 5,052,344 | A | 10/1991 | Kosugi et al. | |
| 5,058,194 | A | 10/1991 | Violi | |
| 5,063,609 | A | 11/1991 | Lorimer | |
| 5,107,606 | A | 4/1992 | Tsubaki et al. | 34/133 |
| 5,146,693 | A | 9/1992 | Dottor et al. | 34/77 |
| 5,152,252 | A | 10/1992 | Bolton et al. | |
| 5,154,197 | A | 10/1992 | Auld et al. | |
| 5,172,654 | A | 12/1992 | Christiansen | |
| 5,172,888 | A | 12/1992 | Ezekoye | |
| 5,199,455 | A | 4/1993 | Dlouhy | |
| 5,212,969 | A | 5/1993 | Tsubaki et al. | 68/19.2 |
| 5,219,370 | A * | 6/1993 | Farrington et al. | 8/158 |
| 5,219,371 | A | 6/1993 | Shim et al. | 8/149 |
| 5,279,676 | A | 1/1994 | Oslin et al. | |
| 5,291,758 | A | 3/1994 | Lee | 68/196 |
| 5,293,761 | A | 3/1994 | Jang | 68/15 |
| 5,315,727 | A | 5/1994 | Lee | 8/159 |
| 5,345,637 | A | 9/1994 | Pastryk et al. | 8/158 |
| 5,570,626 | A | 11/1996 | Vos | |
| 5,619,983 | A | 4/1997 | Smith | |
| 5,727,402 | A | 3/1998 | Wada | |
| 5,732,664 | A | 3/1998 | Badeaux, Jr. | |
| 5,743,034 | A | 4/1998 | Debourg et al. | |
| 5,758,377 | A | 6/1998 | Cimetta et al. | |
| 5,768,730 | A | 6/1998 | Matsumoto et al. | |
| 5,815,637 | A | 9/1998 | Allen et al. | |
| 6,029,300 | A * | 2/2000 | Kawaguchi et al. | 8/159 |
| 6,067,403 | A | 5/2000 | Morgandi | 392/401 |
| 6,094,523 | A | 7/2000 | Zelina et al. | |
| 6,122,849 | A | 9/2000 | Kida et al. | |
| 6,161,306 | A | 12/2000 | Clodic | 34/321 |
| 6,178,671 | B1 | 1/2001 | Zwanenburg et al. | |
| 6,295,691 | B1 | 10/2001 | Chen | |
| 6,327,730 | B1 | 12/2001 | Corbett | |
| 6,434,857 | B1 | 8/2002 | Anderson et al. | |
| 6,451,066 | B2 | 9/2002 | Estes et al. | |
| 6,460,381 | B1 | 10/2002 | Yoshida et al. | |
| 6,585,781 | B1 | 7/2003 | Roseen | 8/149.1 |
| 6,622,529 | B1 | 9/2003 | Crane | |
| 6,647,931 | B1 | 11/2003 | Morgandi et al. | |
| 6,691,536 | B2 | 2/2004 | Severns et al. | |
| 6,772,751 | B2 | 8/2004 | Deuringer et al. | |
| 6,789,404 | B2 | 9/2004 | Kim et al. | |
| 6,823,878 | B1 | 11/2004 | Gadini | |
| 6,874,191 | B2 | 4/2005 | Kim et al. | |
| 6,889,399 | B2 | 5/2005 | Steiner et al. | 8/159 |
| 7,021,087 | B2 | 4/2006 | France et al. | |
| 7,096,828 | B2 | 8/2006 | Tippmann | |
| 7,290,412 | B2 | 11/2007 | Yang et al. | |
| 7,325,330 | B2 | 2/2008 | Kim et al. | |
| 7,404,304 | B2 | 7/2008 | Yang et al. | |
| 7,421,752 | B2 | 9/2008 | Donadon et al. | |
| 7,490,491 | B2 | 2/2009 | Yang et al. | |
| 7,490,493 | B2 | 2/2009 | Kim et al. | |
| 7,520,146 | B2 | 4/2009 | Kim et al. | |
| 7,600,402 | B2 | 10/2009 | Shin et al. | |
| 7,765,628 | B2 * | 8/2010 | Wong et al. | 8/158 |
| 2001/0032599 | A1 | 10/2001 | Fischer et al. | |
| 2003/0215226 | A1 | 11/2003 | Nomura et al. | |
| 2003/0226999 | A1 | 12/2003 | Hage | |
| 2004/0163184 | A1 | 8/2004 | Waldron et al. | |
| 2004/0187527 | A1 | 9/2004 | Kim et al. | 68/5 |
| 2004/0187529 | A1 | 9/2004 | Kim et al. | 68/207 |
| 2004/0200093 | A1 | 10/2004 | Wunderlin et al. | |
| 2004/0206480 | A1 | 10/2004 | Maydanik et al. | |
| 2004/0221474 | A1 | 11/2004 | Slutsky et al. | |
| 2004/0237603 | A1 | 12/2004 | Kim et al. | |
| 2004/0244432 | A1 | 12/2004 | Kim et al. | 68/5 |
| 2004/0244438 | A1 | 12/2004 | North | 68/23.2 |
| 2004/0255391 | A1 * | 12/2004 | Kim et al. | 8/149.3 |
| 2005/0000031 | A1 | 1/2005 | Price et al. | |
| 2005/0028297 | A1 | 2/2005 | Kim et al. | |
| 2005/0034248 | A1 | 2/2005 | Oh et al. | 8/149 |
| 2005/0034249 | A1 | 2/2005 | Oh et al. | 8/159 |
| 2005/0034250 | A1 | 2/2005 | Oh et al. | 8/159 |
| 2005/0034487 | A1 | 2/2005 | Oh et al. | 68/5 |
| 2005/0034488 | A1 | 2/2005 | Oh et al. | 68/5 |
| 2005/0034489 | A1 | 2/2005 | Oh et al. | 68/5 |
| 2005/0034490 | A1 | 2/2005 | Oh et al. | 68/5 |
| 2005/0050644 | A1 | 3/2005 | Severns et al. | |
| 2005/0072382 | A1 | 4/2005 | Tippmann, Sr. | |
| 2005/0072383 | A1 | 4/2005 | Powell et al. | |
| 2005/0092035 | A1 | 5/2005 | Shin et al. | 68/275 |
| 2005/0132503 | A1 | 6/2005 | Yang et al. | 8/149 |
| 2005/0132504 | A1 | 6/2005 | Yang et al. | 8/159 |
| 2005/0132756 | A1 | 6/2005 | Yang et al. | 68/12.15 |
| 2005/0144734 | A1 | 7/2005 | Yang et al. | 8/149.3 |
| 2005/0144735 | A1 | 7/2005 | Yang et al. | 8/149.3 |
| 2005/0144737 | A1 | 7/2005 | Roepke et al. | |
| 2005/0205482 | A1 | 9/2005 | Gladney | |
| 2005/0220672 | A1 | 10/2005 | Takahashi et al. | |
| 2005/0223503 | A1 | 10/2005 | Hong et al. | 8/158 |
| 2005/0223504 | A1 | 10/2005 | Lee et al. | |
| 2005/0252250 | A1 | 11/2005 | Oh et al. | |
| 2005/0262644 | A1 | 12/2005 | Oak et al. | |
| 2006/0000242 | A1 | 1/2006 | Yang et al. | |
| 2006/0001612 | A1 | 1/2006 | Kim | |
| 2006/0005581 | A1 | 1/2006 | Banba | |
| 2006/0010613 | A1 | 1/2006 | Jeon et al. | |
| 2006/0010727 | A1 | 1/2006 | Fung | |
| 2006/0010937 | A1 | 1/2006 | Kim et al. | |
| 2006/0016020 | A1 | 1/2006 | Park | |
| 2006/0090524 | A1 | 5/2006 | Jeon et al. | |
| 2006/0096333 | A1 | 5/2006 | Park et al. | |
| 2006/0101586 | A1 | 5/2006 | Park et al. | |
| 2006/0101588 | A1 | 5/2006 | Park et al. | |
| 2006/0101867 | A1 | 5/2006 | Kleker | |
| 2006/0107468 | A1 | 5/2006 | Urbanet et al. | |
| 2006/0112585 | A1 | 6/2006 | Choi et al. | |
| 2006/0117596 | A1 | 6/2006 | Kim et al. | |
| 2006/0130354 | A1 | 6/2006 | Choi et al. | |
| 2006/0137105 | A1 | 6/2006 | Hong et al. | |
| 2006/0137107 | A1 | 6/2006 | Lee et al. | |
| 2006/0150689 | A1 | 7/2006 | Kim et al. | |
| 2006/0151005 | A1 | 7/2006 | Kim et al. | |
| 2006/0151009 | A1 | 7/2006 | Kim et al. | |
| 2006/0191077 | A1 | 8/2006 | Oh et al. | |

| | | | |
|---|---|---|---|
| 2006/0191078 | A1 | 8/2006 | Kim et al. |
| 2006/0277690 | A1 | 12/2006 | Pyo et al. |
| 2007/0006484 | A1 | 1/2007 | Moschuetz et al. |
| 2007/0028398 | A1 | 2/2007 | Kwon et al. |
| 2007/0084000 | A1 | 4/2007 | Bernardino et al. |
| 2007/0101773 | A1 | 5/2007 | Park et al. |
| 2007/0107472 | A1 | 5/2007 | Kim et al. |
| 2007/0107884 | A1 | 5/2007 | Sirkar et al. |
| 2007/0125133 | A1 | 6/2007 | Oh et al. |
| 2007/0130697 | A1 | 6/2007 | Oh et al. |
| 2007/0136956 | A1 | 6/2007 | Kim et al. |
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283509 | A1 | 12/2007 | Wong et al. |
| 2007/0283728 | A1 | 12/2007 | Wong et al. |
| 2008/0006063 | A1 | 1/2008 | Ahn et al. |
| 2008/0019864 | A1 | 1/2008 | Savage et al. |
| 2008/0028801 | A1 | 2/2008 | Czyzewski et al. |
| 2008/0115740 | A1 | 5/2008 | You |
| 2009/0056034 | A1 | 3/2009 | Herkle et al. |
| 2009/0056036 | A1 | 3/2009 | Herkle et al. |
| 2009/0056762 | A1 | 3/2009 | Pinkowski et al. |

FOREIGN PATENT DOCUMENTS

| | | | |
|---|---|---|---|
| CN | 1664222 | A | 9/2005 |
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 243328 | | 2/1912 |
| DE | 283533 | | 4/1915 |
| DE | 317887 | | 1/1920 |
| DE | 427025 | | 3/1926 |
| DE | 435088 | | 10/1926 |
| DE | 479594 | | 7/1929 |
| DE | 668963 | | 12/1938 |
| DE | 853433 | | 10/1952 |
| DE | 894685 | | 10/1953 |
| DE | 1847016 | | 2/1962 |
| DE | 1873622 | | 6/1963 |
| DE | 2202345 | | 8/1973 |
| DE | 2226373 | | 12/1973 |
| DE | 2245532 | | 3/1974 |
| DE | 7340082 | | 5/1975 |
| DE | 2410107 | | 9/1975 |
| DE | 2533759 | | 2/1977 |
| DE | 3103529 | A1 | 8/1982 |
| DE | 3139466 | A1 | 4/1983 |
| DE | 3408136 | | 9/1985 |
| DE | 3501008 | | 7/1986 |
| DE | 3627988 | | 4/1987 |
| DE | 8703344 | | 8/1988 |
| DE | 4116673 | A1 | 11/1992 |
| DE | 4225847 | | 2/1994 |
| DE | 4413213 | | 10/1995 |
| DE | 4443338 | | 6/1996 |
| DE | 29707168 | | 7/1997 |
| DE | 19730422 | A1 | 1/1999 |
| DE | 19736794 | | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | | 12/2001 |
| DE | 10035904 | | 1/2002 |
| DE | 10039904 | | 2/2002 |
| DE | 10043165 | | 2/2002 |
| DE | 10312163 | | 11/2003 |
| DE | 10260163 | A1 | 7/2004 |
| DE | 176355 | | 10/2006 |
| DE | 102005051721 | A1 | 5/2007 |
| DE | 102007023020 | B3 | 5/2008 |
| EP | 0043122 | | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0284554 | | 9/1988 |
| EP | 0287990 | | 10/1988 |
| EP | 0302125 | | 8/1989 |
| EP | 363708 | A2 | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 0821096 | A1 | 1/1998 |
| EP | 0839943 | A1 | 5/1998 |
| EP | 0816550 | | 7/1998 |
| EP | 1163387 | | 12/2001 |
| EP | 1275767 | | 1/2003 |
| EP | 1351016 | | 10/2003 |
| EP | 1411163 | | 4/2004 |
| EP | 1437547 | | 7/2004 |
| EP | 1441059 | | 7/2004 |
| EP | 1441175 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1507033 | A1 | 2/2005 |
| EP | 1529875 | | 5/2005 |
| EP | 1544345 | | 6/2005 |
| EP | 1548175 | | 6/2005 |
| EP | 1550760 | | 7/2005 |
| EP | 1555338 | | 7/2005 |
| EP | 1555339 | | 7/2005 |
| EP | 1555340 | | 7/2005 |
| EP | 1561853 | | 8/2005 |
| EP | 1584728 | | 10/2005 |
| EP | 1619284 | A1 | 1/2006 |
| EP | 1655408 | A1 | 5/2006 |
| EP | 1659205 | A2 | 5/2006 |
| EP | 1666655 | A2 | 6/2006 |
| EP | 1681384 | A1 | 7/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | | 10/1976 |
| FR | 2525645 | A1 | 10/1983 |
| FR | 2581442 | A2 | 11/1986 |

| | | | |
|---|---|---|---|
| FR | 2688807 | A1 | 9/1993 |
| GB | 10423 | | 0/1909 |
| GB | 21024 | | 0/1910 |
| GB | 21286 | | 0/1898 |
| GB | 191010567 | A | 0/1911 |
| GB | 191010792 | A | 0/1911 |
| GB | 191022943 | A | 0/1911 |
| GB | 191024005 | A | 0/1911 |
| GB | 191103554 | A | 0/1911 |
| GB | 102466 | A | 12/1916 |
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | A | 6/1969 |
| GB | 1331623 | | 9/1973 |
| GB | 1352955 | | 5/1974 |
| GB | 1366852 | A | 9/1974 |
| GB | 2219603 | A | 12/1989 |
| GB | 2309071 | A | 7/1997 |
| GB | 2348213 | | 9/2000 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 6/1982 |
| JP | 57032858 | | 7/1982 |
| JP | 60138399 | A | 7/1985 |
| JP | 61128995 | | 6/1986 |
| JP | 62066891 | | 3/1987 |
| JP | 2049700 | A | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | A | 9/1990 |
| JP | 02267402 | | 11/1990 |
| JP | 03025748 | | 6/1991 |
| JP | 3137401 | A | 6/1991 |
| JP | 04158896 | | 6/1992 |
| JP | 4158896 | A | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 06123360 | | 5/1994 |
| JP | 08261689 | | 10/1996 |
| JP | 9133305 | A | 5/1997 |
| JP | 10235088 | A | 9/1998 |
| JP | 11047488 | A | 2/1999 |
| JP | 11164979 | | 6/1999 |
| JP | 11164980 | | 6/1999 |
| JP | 11226290 | | 8/1999 |
| JP | 2000176192 | | 6/2000 |
| JP | 2003019382 | | 1/2003 |
| JP | 2003093775 | | 4/2003 |
| JP | 2003311068 | | 11/2003 |
| JP | 2003311084 | | 11/2003 |
| JP | 2003320324 | | 11/2003 |
| JP | 2003326077 | | 11/2003 |
| JP | 2004061011 | | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | A | 5/2006 |
| JP | 2004167131 | | 9/2007 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 1001146947 | | 10/1998 |
| KR | 20010015043 | | 2/2001 |
| KR | 10220010010111 | | 2/2001 |
| KR | 20040085509 | A | 10/2004 |
| KR | 20050017481 | A | 2/2005 |
| KR | 20060031165 | A | 4/2006 |
| WO | 9214954 | | 9/1992 |
| WO | 9307798 | A1 | 4/1993 |
| WO | 9319237 | A1 | 9/1993 |
| WO | 97/15709 | | 5/1997 |
| WO | 98/03175 | | 1/1998 |
| WO | 01/11134 | | 2/2001 |
| WO | 0174129 | A2 | 10/2001 |
| WO | 03/012185 | | 2/2003 |
| WO | 03012185 | A2 | 2/2003 |
| WO | 03057966 | | 7/2003 |
| WO | 2004/059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | 2006070317 | A1 | 7/2006 |
| WO | 2006090973 | | 8/2006 |
| WO | 2006091054 | | 8/2006 |
| WO | 2006091057 | A1 | 8/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |
| WO | 2006101336 | A1 | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006101377 | A1 | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007004785 | A1 | 1/2007 |
| WO | 2007007241 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |

| | | | |
|---|---|---|---|
| WO | 2007058477 | A1 | 5/2007 |
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007116255 | A1 | 10/2007 |
| WO | 2007145448 | A2 | 12/2007 |
| WO | 2008004801 | A2 | 1/2008 |

* cited by examiner

STEAM WASHING MACHINE OPERATION METHOD HAVING DRY SPIN PRE-WASH

BACKGROUND OF THE INVENTION

1. Field of the Invention

The invention relates to a method of operating a washing machine using steam.

2. Description of the Related Art

The cleaning performance of a washing machine depends on many factors, such as chemical, mechanical, and thermal energy inputs during a wash cycle. The chemical energy relates to the detergent efficiency and water quality, the mechanical energy corresponds to fluid flow and fabric flexing and movement, and the thermal energy is associated with heating the wash liquid. However, a wash cycle that optimizes the chemical, mechanical, and thermal energy inputs to achieve superior performance does not necessarily correspond to efficient usage of natural resources, such as water and fossil fuels, including coal, oil, and natural gas. In view of rising resource costs and concern for environmental conservation, a practical balance between energy inputs and resource usage should be considered in the operation of washing machines.

One approach of reducing water consumption and power (i.e., natural gas or electricity) consumption has been to use steam rather than an immersion heater to heat the wash liquid. With an immersion heater, a larger volume of liquid than is needed for washing must be employed to maintain the heater completely submerged and thereby avoid damage to the surrounding structure. Furthermore, the heater must be powered for a relatively long period of time to heat all of the water required to submerge the heater.

Washing machines with steam generators can use less water than those with immersion heaters. Steam can be injected into the sump of the washing machine or directly into the tub or perforated drum rotatably mounted in the tub to heat the wash liquid. Although steam washing machines have been well-known for some time, methods of operating such washing machines to optimize cleaning performance and efficiently utilize natural resources are still needed.

SUMMARY OF THE INVENTION

A method according to one embodiment of the invention for operating a horizontal axis washing machine having a tub with a drum rotatably mounted in the tub and configured to hold a fabric load comprises introducing liquid into the drum to wet the fabric load; and spinning the drum to distribute the fabric load about the drum prior to the introducing of the liquid.

The liquid can be introduced while the drum is spinning.

The method can further comprise rotating the drum at a tumble speed after the spinning of the drum.

The method can further comprise recirculating the liquid between the tub and the drum. The recirculating can occur during the spinning of the drum. The method can further comprise adding liquid to at least one of the tub and the drum to compensate for liquid absorbed by the fabric load. The adding, recirculating, and spinning can repeat until a ratio of fabric load weight to liquid weight reaches a predetermined ratio. The predetermined ratio can be in a range of about 1:0.5 and 1:2.7. The predetermined ratio can be in a range of about 1:1 and 1:2.

The method can further comprise introducing steam into at least one of the tub and the drum. The introducing of the steam can occur after the introducing of the liquid and the spinning of the drum. The method can further comprise rotating the drum during the introduction of the steam. The rotating of the drum during the introduction of steam can comprise rotating the drum at a tumble speed.

The introducing and spinning can be part of a pre-wash step, and a washing step follows the pre-wash step. A ratio of fabric load weight to liquid weight can be greater during the pre-wash step than during the washing step. The method can further comprise introducing steam into at least one of the tub and the drum at least one of during the pre-wash step, between the pre-wash step and the washing step, and during the washing step. The method can further comprise a rinsing step and an extraction step following the washing step.

The liquid can comprise a detergent solution.

DESCRIPTION OF EMBODIMENTS OF THE INVENTION

Figure 1:
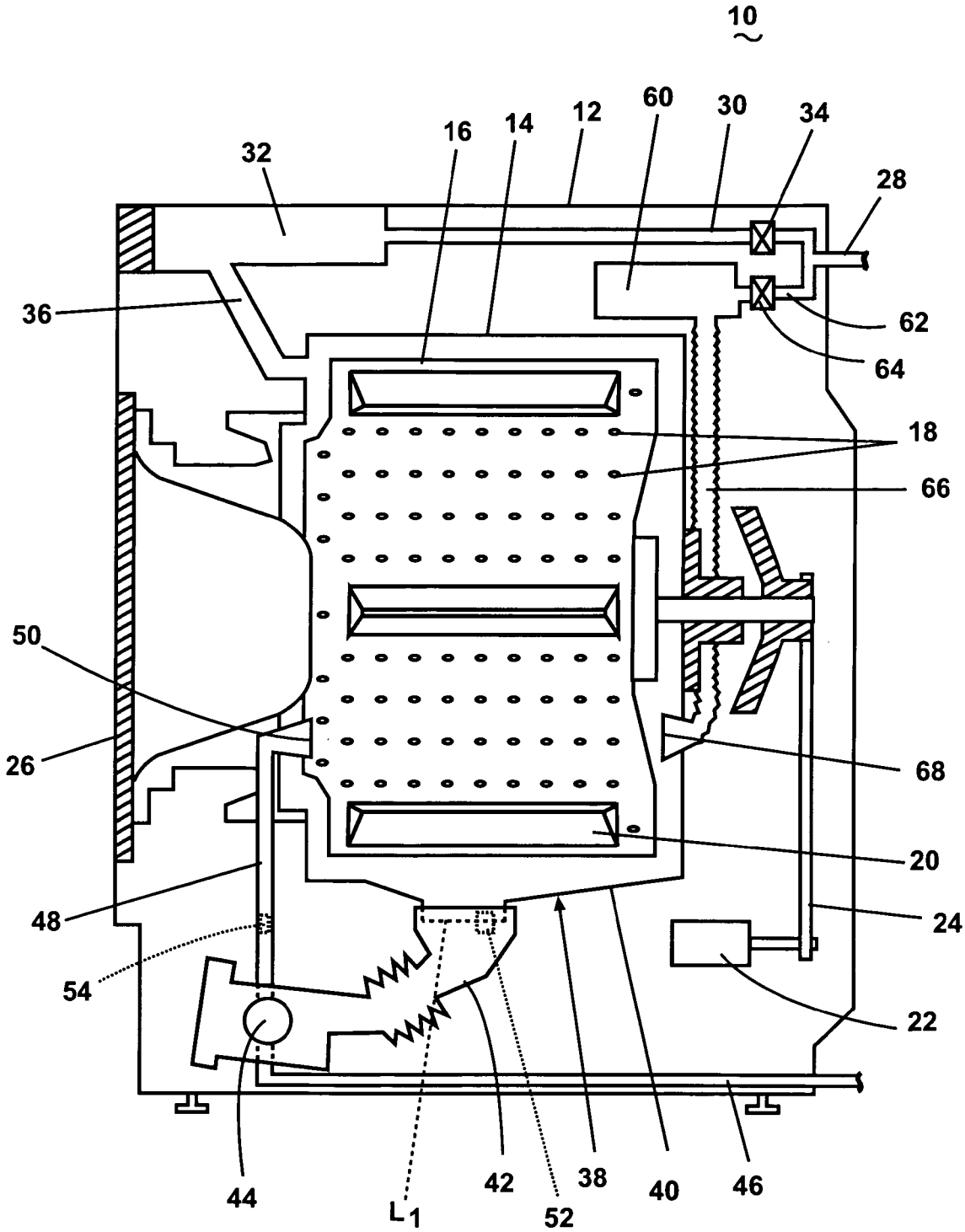
FIG. 1 is a schematic view of a horizontal axis steam washing machine according to one embodiment of the invention.

Referring now to the figures, FIG. 1 is a schematic view of an exemplary steam washing machine 10 that can be used to execute a method of operating a washing machine according to one embodiment of the invention. The washing machine 10 comprises a cabinet 12 that houses a stationary tub 14. A rotatable drum 16 mounted within the tub 14 includes a plurality of perforations 18, and liquid can flow between the tub 14 and the drum 16 through the perforations 18. The drum 16 further comprises a plurality of baffles 20 disposed on an inner surface of the drum 16 to lift fabric items contained in the drum 16 while the drum 16 rotates, as is well known in the washing machine art. A motor 22 coupled to the drum 16 through a belt 24 rotates the drum 16. Both the tub 14 and the drum 16 can be selectively closed by a door 26.

Washing machines are typically categorized as either a vertical axis washing machine or a horizontal axis washing machine. As used herein, the "vertical axis" washing machine refers to a washing machine comprising a rotatable drum, perforate or imperforate, that holds fabric items and a fabric moving element, such as an agitator, impeller, nutator, and the like, that induces movement of the fabric items to impart mechanical energy to the fabric articles for cleaning action. In some vertical axis washing machines, the drum rotates about a vertical axis generally perpendicular to a surface that supports the washing machine. However, the rotational axis need not be vertical. The drum can rotate about an axis inclined relative to the vertical axis. As used herein, the "horizontal axis" washing machine refers to a washing machine having a rotatable drum, perforated or imperforate, that holds fabric items and washes the fabric items by the fabric items rubbing against one another as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis. Vertical axis and horizontal axis machines are best differentiated by the manner in which they impart mechanical energy to the fabric articles. The illustrated exemplary washing machine of FIG. 1 is a horizontal axis washing machine.

The motor 22 can rotate the drum 16 at various speeds in opposite rotational directions. In particular, the motor 22 can rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 can be facilitated by the baffles 20. Typically, the force applied to the fabric items at the tumbling speeds is less than about 1 G. Alternatively, the motor 22 can rotate the drum 16 at spin speeds wherein the fabric items rotate with the drum 16 without falling. In the washing machine art, the spin speeds can also be referred to as satellizing speeds or sticking speeds. Typically, the force applied to the fabric items at the spin speeds is greater than or about equal to 1 G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The washing machine 10 of FIG. 1 further comprises a liquid supply and recirculation system. Liquid, such as water, can be supplied to the washing machine 10 through a liquid inlet 28. A first supply conduit 30 fluidly couples the liquid inlet 28 to a detergent dispenser 32. A first inlet valve 34 controls flow of the liquid from the liquid inlet 28 and through the first supply conduit 30 to the detergent dispenser 32. The first inlet valve 34 can be positioned in any suitable location between the liquid inlet 28 and the detergent dispenser 32. A liquid conduit 36 fluidly couples the detergent dispenser 32 with the tub 14. The liquid conduit 36 can couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 enters a space between the tub 14 and the drum 16 and flows by gravity to a sump 38 formed in part by a lower portion 40 of the tub 14. The sump 38 is also formed by a sump conduit 42 that fluidly couples the lower portion 40 of the tub 14 to a pump 44. The pump 44 can direct fluid to a drain conduit 46, which drains the liquid from the washing machine 10, or to a recirculation conduit 48, which terminates at a recirculation inlet 50. The recirculation inlet 50 directs the liquid from the recirculation conduit 48 into the drum 16. The recirculation inlet 50 can introduce the liquid into the drum 16 in any suitable manner, such as by spraying, dripping, or providing a steady flow of the liquid.

The exemplary washing machine 10 further includes a steam generation system. The steam generation system comprises a steam generator 60 that receives liquid from the liquid inlet 28 through a second supply conduit 62. A second inlet valve 64 controls flow of the liquid from the liquid inlet 28 and through the second supply conduit 62 to the steam generator 60. The second inlet valve 64 can be positioned in any suitable location between the liquid inlet 28 and the steam generator 60. A steam conduit 66 fluidly couples the steam generator 60 to a steam inlet 68, which introduces steam into the tub 14. The steam inlet 68 can couple with the tub 14 at any suitable location on the tub 14 and is shown as being coupled to a rear wall of the tub 14 in FIG. 1 for exemplary purposes. The steam that enters the tub 14 through the steam inlet 68 subsequently enters the drum 16 through the perforations 18. Alternatively, the steam inlet 68 can be configured to introduce the steam directly into the drum 16. The steam inlet 68 can introduce the steam into the tub 14 in any suitable manner. The washing machine 10 can further include an exhaust conduit that directs steam that leaves the tub 14 externally of the washing machine 10. The exhaust conduit can be configured to exhaust the steam directly to the exterior of the washing machine 10. Alternatively, the exhaust conduit can be configured to direct the steam through a condenser prior to leaving the washing machine 10.

The steam generator 60 can be any type of device that converts the liquid to steam. For example, the steam generator 60 can be a tank-type steam generator that stores a volume of liquid and heats the volume of liquid to convert the liquid to steam. Alternatively, the steam generator 60 can be an in-line steam generator that converts the liquid to steam as the liquid flows through the steam generator 60. The steam generator 60 can produce pressurized or non-pressurized steam.

In addition to producing steam, the steam generator 60, whether an in-line steam generator, a tank-type steam generator, or any other type of steam generator, can heat water to a temperature below a steam transformation temperature, whereby the steam generator 60 produces hot water. The hot water can be delivered to the tub 14 and/or drum 16 from the steam generator 60. The hot water can be used alone or can optionally mix with cold water in the tub 14 and/or drum 16. Using the steam generator to produce hot water can be useful when the steam generator 60 couples only with a cold water source at the liquid inlet 28.

The liquid supply and recirculation system and the steam generator system can differ from the configuration shown in FIG. 1, such as by inclusion of other valves, conduits, wash aid dispensers, and the like, to control the flow of liquid and steam through the washing machine 10 and for the introduction of more than one type of detergent/wash aid. For example, a valve can be located in the liquid conduit 36, in the recirculation conduit 48, and in the steam conduit 66. Furthermore, an additional conduit can be included to couple the liquid inlet 28 directly to the tub 14 or the drum 16 so that the liquid provided to the tub 14 or the drum 16 does not have to pass through the detergent dispenser 32. Alternatively, the liquid can be provided to the tub 14 or the drum 16 through the steam generator 60 rather than through the detergent dispenser 32 or the additional conduit. As another example, the recirculation conduit 48 can be coupled to the liquid conduit 36 so that the recirculated liquid enters the tub 14 or the drum 16 at the same location where the liquid from the detergent dispenser 32 enters the tub 14. The liquid supply and recirculation system can further comprise sensors, such as a liquid level sensor 52 in the sump 38 or a liquid flow sensor 54 in the recirculation conduit 48. The liquid level sensor 52 and the liquid flow sensor 54 can be any type of sensor, such as pressure sensors.

The washing machine 10 can further comprise a controller coupled to various working components of the washing machine 10, such as the liquid level sensor 52, the liquid flow sensor 54, the pump 44, the motor 22, the first and second inlet valves 34, 64, the detergent dispenser 32, and the steam generator 60, to control the operation of the washing machine 10. The controller can receive data from the working components and can provide commands, which can be based on the received data, to the working components to execute a desired operation of the washing machine 10.

The washing machine 10 can further include other components, such as a load sensor that detects fabric load size (e.g., weight or volume, which is typically accomplished by monitoring the motor current) and a flow meter (typically accomplished with an in-line flow meter or a time-based determination of liquid flow) that detects a volume of water supplied to the tub 14 and/or drum 16. The information from the load sensor and the flow meter can be used in the execution of the method 100 described below.

The washing machine of FIG. 1 is provided for exemplary purposes only. It is within the scope of the invention to perform the inventive method on other types of washing machines, examples of which are presented below.

Figure 2:
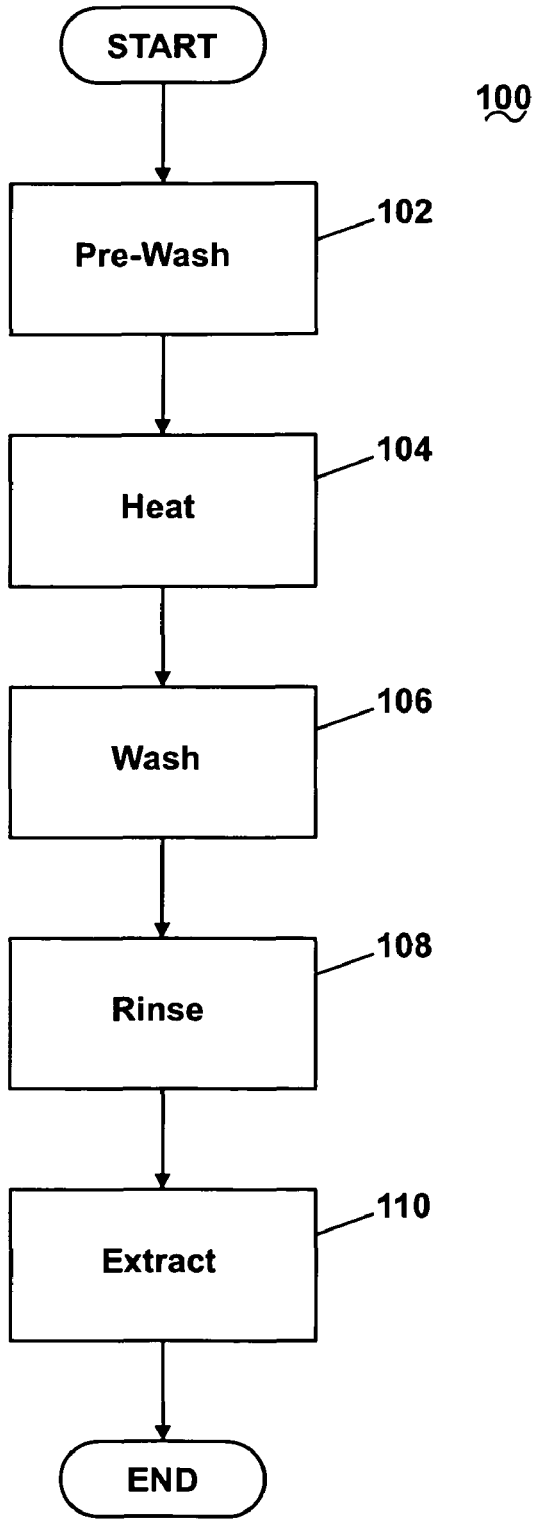
FIG. 2 is a flow chart of a method of operating the steam washing machine of FIG. 1 according to one embodiment of the invention, wherein the method comprises a pre-wash step, a heat step, a wash step, a rinse step, and an extract step.

A method 100 of operating a washing machine with steam according to one embodiment of the invention is illustrated in FIG. 2. In general, the method 100 comprises a pre-wash step 102, a heat step 104, a wash step 106, a rinse step 108, and an extract step 110. In general, the fabric items are subjected to a concentrated detergent solution formed by using a relatively low amount of liquid during the pre-wash step 102, the fabric items are heated during the heat step 104, and an additional amount of liquid is added to wash the clothes during the wash step 106. After the fabric items are washed, they are subjected to rinsing with liquid during the rinse step 108, and the rinse liquid is extracted during the extract step 110. Each of the steps 102, 104, 106, 108, 110 of the method 100 will be described in detail.

During the pre-wash step 102, a concentrated detergent solution flows through the liquid supply and recirculation system, and the drum 16 rotates to facilitate distribution of the concentrated detergent solution to the fabric items. The recirculation of the concentrated detergent solution and the rotation of the drum 16 can occur simultaneously, asynchronously, or a combination thereof. The pre-wash step 102 can also be considered a wetting step whereby the fabric items are wetted with the concentrated detergent solution. According to one embodiment of the invention, the fabric items 102 can be saturated with the concentrated detergent solution.

The detergent solution is a combination of the water that enters through the liquid inlet 28 and the detergent or other wash aid. As used herein, the "detergent solution" refers particularly to the combination of water and detergent and/or other wash aid, and the "liquid" refers to any liquid, whether water alone or water in combination with the detergent or other wash aid. The detergent solution is considered to be concentrated in the pre-wash step 102 because it comprises an amount of liquid less than an amount of liquid utilized during the wash step 106, given a constant amount of detergent or other wash aid. For example, if the pre-wash step 102 utilizes half the liquid but the same amount of detergent as the wash step 106, then the detergent solution is twice as concentrated in the pre-wash step 102 than for the wash step 106.

Selecting the amount of liquid for the pre-wash step 102 depends on several factors. As the amount of water in the detergent solution decreases, the concentration of the detergent increases, thereby increasing the chemical energy input and cleaning performance of the detergent. However, liquid lifts stains from the fabric items, and "free liquid" or liquid not absorbed by the fabric items is needed to accomplish the stain lifting. Furthermore, it is desirable to have a sufficient amount of liquid to ensure uniform distribution of the liquid to the fabric load.

One manner of quantifying the amount of liquid used in the pre-wash step 102 is a ratio of fabric weight to liquid weight. Exemplary ratios for the pre-wash step 102 are discussed in detail below. Another manner of quantifying the amount of liquid used in the pre-wash step 102 involves comparing the volume of liquid with structural features of the washing machine 10. For example, the volume of liquid can be less than a volume required to submerge any portion of the drum 16, either when the liquid is being recirculated or when the liquid is not being recirculated. Keeping the volume of liquid below the drum 16 prevents sudslock (i.e., drag force between the drum 16 and the tub 14 due to the presence of suds) when the drum 16 spins. According to one embodiment of the invention, the pre-wash step 102 utilizes an amount of liquid sufficient to saturate the fabric items. The amount of liquid can equal an amount required to saturate the fabric items or can exceed the amount required to saturate the fabric items.

The rotating of the drum 16 during the pre-wash step 102 can correspond to spinning the drum 16, tumbling the drum 16, or a combination of spinning the drum 16 and tumbling the drum 16. For example, according to one embodiment of the invention, the pre-wash step 102 comprises recirculating the liquid and spinning the drum 16 simultaneously, asynchronously, or a combination thereof. The spinning of the drum 16 distributes the fabric items about the drum 16 and forces the liquid in the fabric items to permeate through the fabric items, pass through the perforations 18 in the drum 16, and flow to the sump 38, where the liquid can be recirculated. Tumbling of the drum 16 can be incorporated into this example, wherein the drum 16 can be tumbled after the spinning of the drum 16 to redistribute the fabric items amongst themselves. Alternatively, if the spinning of the drum 16 does not occur during the recirculation of the liquid, the tumbling of the drum 16 can occur during the recirculation of the liquid, which facilitates distribution of the liquid among the fabric items.

During the spinning of the drum 16 and/or the tumbling of the drum 16, the drum 16 can be spun or tumbled in any of several manners, such as at a constant speed, at multiple speeds, according to a speed ramp profile having multiple spin/tumble speeds, or according to a continuous speed ramp. For example, during the spinning of the drum 16, the drum 16 can rotate at a single spin speed, two or more spin speeds (e.g., rotate at a first spin speed for a predetermined period of time followed by rotate at a second spin for a predetermined period of time), at a spin profile having several discrete spin speeds, or at a continuously increasing speed ramp between a first spin speed and a second spin speed. The drum 16 can also be alternatingly tumbled and spun whereby the speed of the drum 16 alternatingly increases and decreases. Furthermore, during the spinning of the drum 16 and/or the tumbling of the drum 16, the drum 16 can be spun or tumbled in a single direction or in alternating directions.

The spin speed and a duration of spinning the drum 16 determines, at least in part, a saturation rate of the fabric items. As stated above, one method of quantifying the amount of liquid used during the pre-wash step 102 involves using the ratio of fabric weight to liquid weight, and the spin speed and the spinning time can be selected in concert with a desired ratio. For example, the desired ratio can be chosen based on the spin speed and the spinning time required to achieve the ratio. As the ratio increases (i.e., the amount of the liquid decreases), the spin speed and the spinning time to achieve saturation also increases. A lower spin speed could be preferred over a higher spin speed, or vice-versa, or it could be desirable to avoid a spin speed in a certain range, such as a speed range corresponding to a natural resonance of the washing machine 10. It could also be desirable to avoid excessively long spinning times, which directly corresponds to lengthening the pre-wash step 102 and a longer overall operation of the washing machine 10. Other factors relevant to the desired ratio include uniform distribution of the liquid among the fabric items and the above-mentioned chemical energy input of the detergent in the liquid and the presence of the free liquid. As the ratio increases, it becomes more difficult to uniformly wet the fabric items with the liquid.

While the desired ratio can vary based on size and type of the fabric items and the structure of the washing machine 10, a suitable range for the ratio has been determined to be from about 1:0.5 to 1:2.7. Values of the liquid weight portion of the ratio below about 0.5 correspond to excessively long spinning times. When the value of the liquid weight portion of the ratio increases above about 2.7, spinning is no longer needed to extract the liquid from the fabric items to collect enough liquid in the sump 38 for continuous recirculation of the liquid. Another suitable range for the ratio has been determined to be from about 1:0.5 to 1:2.3. The value of the liquid weight portion at one end of the exemplary range has been reduced to 2.3 because between values of 2.3 and 2.7, spinning is no longer needed to extract the liquid from the fabric items to collect enough liquid in the sump for intermittent recirculation of the liquid. Within the range of about 1:0.5 to 1:2.3, suitable performance and acceptable spin speeds and spinning times have been observed in a range of about 1:1 to 1:2. Exemplary desired ratios within the latter range include about 1:1.2, 1:1.5, and 1:1.7.

Exemplary executions of the pre-wash step 102 are illustrated in flow charts in FIGS. 3-7. Descriptions of each of the exemplary executions follow, with it being understood that the flow charts and descriptions are provided for illustrative purposes only. It is within the scope of the invention for the pre-wash step 102 to differ from the exemplary executions of FIGS. 3-7. The exemplary executions are described with respect to the exemplary washing machine 10 in FIG. 1, but it is within the scope of the invention to utilize other washing machines. The exemplary executions do not include a step of adding the fabric items to the drum 16; rather, it is to be inferred that the fabric items are added either prior to the execution of the pre-wash step 102 or at some time in the beginning of the pre-wash step 102. If the timing of adding the fabric items to the pre-wash step 102 is critical, then the preferred timing is indicated below.

Figure 3:
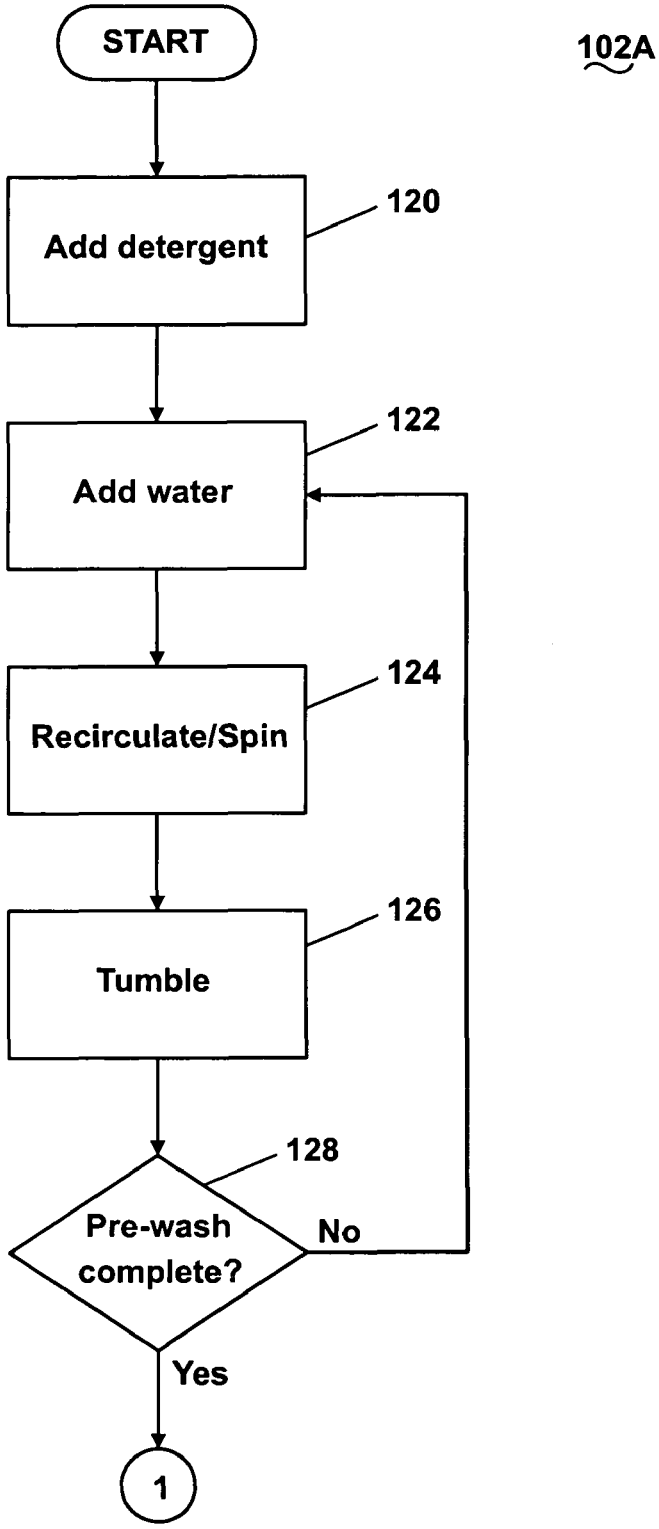
FIG. 3 is a flow chart of a first exemplary execution of the pre-wash step of the method of FIG. 2.

Referring now to FIG. 3, a first exemplary pre-wash step 102A begins with a user adding detergent and/or other wash aid (hereinafter referred to collectively as detergent) to the washing machine 10 in step 120. The user can place the detergent in the detergent dispenser 32 or directly into the drum 16. Next, water is added in step 122 via the detergent dispenser 32 through the liquid conduit 36. Thus, if the user placed the detergent in the detergent dispenser 32, then the detergent flows with the water through the liquid conduit 36 in the step 122. The liquid from the liquid conduit 36 enters the tub 14 and flows to the sump 38. The water can be added to achieve a first volume of liquid. The achievement of the first volume of liquid can be determined on any suitable basis, such as by adding the water for a known period of time, by detecting a liquid level, such as a liquid level in the sump 38 with the liquid level sensor 52, or by detecting a volumetric flow rate of the water through the first supply conduit 30 or the liquid conduit 36. Regardless of how the achievement of the first volume of liquid is determined, the first volume of liquid can correspond to a predetermined liquid level in the sump 38 that is below the drum 16, as discussed above. An exemplary liquid level for the first volume of liquid is illustrated by a dashed line labeled L1 in FIG. 1.

In step 124, the pump 44 pumps the liquid from the sump 38 and through the recirculation conduit 48 to the recirculation inlet 50 to recirculate the liquid from the tub 14 to the drum 16, thereby wetting the fabric items in the drum 16 with the liquid. The step 124 also includes spinning the drum 16, which can occur while the liquid is recirculating or after the liquid has been recirculated. Spinning the drum 16 while the liquid recirculates advantageously distributes the fabric items around the drum 16 whereby the recirculating liquid can be applied to the distributed fabric items rather than to a stationary pile of the fabric items, which would be the case for the stationary drum 16. Exemplary spin speeds for the pre-wash step 102A are about 100 rpm and about 300 rpm. The drum 16 can spin in one direction only or can spin in alternating directions. Regardless of the relative timing of the recirculation of the liquid and the spinning of the drum 16, the fabric items absorb the recirculating liquid that enters the drum 16, and the spinning of the drum 16 forces the liquid to permeate through the fabric items and flow through the perforations 18 in the drum 16. While some of the liquid remains in the fabric items, the liquid that flows through the perforations 18 falls by gravity for collection in the sump 38.

The recirculation and spinning of step 124 can be optionally followed by tumbling the drum 16 in step 126. When the drum 16 tumbles, the fabric items fall back to the lowest location of the drum 16 and can be redistributed amongst each other. An exemplary tumble speed for the pre-wash step 102A is about 40 rpm. The drum 16 can tumble in one direction only or can tumble in alternating directions.

After the optional tumbling step 124, a status of the pre-wash step 102A is evaluated at step 128. In particular, it is determined whether the pre-wash step 102A is complete. The completion of the pre-wash step 102A can be evaluated in any suitable manner. For example, the pre-wash step 102A can be terminated when the fabric items are sufficiently saturated or when reaching the desired ratio of fabric weight to liquid weight, which can also be evaluated in any suitable manner. As examples, the pre-wash step 102A can be terminated after a predetermined period of time; after the add water step 122, the recirculate/spin step 124, and the tumble step 126, if performed, are executed a predetermined number of times; or when the liquid level is about the same as the predetermined liquid level. Regarding the last example, the fabric items, when not saturated, absorb a portion of the recirculating liquid; therefore, the liquid that flows through the perforations 18 and collects in the sump 38 has a liquid level less than the predetermined level. Conversely, when the fabric items are saturated, the recirculating liquid permeates through the fabric items, flows through the perforations 18, and collects in the sump 38 to a level substantially the same as the predetermined level.

If it is determined in step 128 that the pre-wash step 102A is not complete, then the pre-wash step 102A returns to the add water step 122 and repeats. During the add water step 122, the amount of water added can be an amount sufficient to compensate for the liquid absorbed by the fabric items and thereby maintain the first volume of liquid. This can be accomplished, for example, by adding water until the liquid level in the sump 38 returns to the predetermined level. If it is determined in step 128 that the pre-wash step 102A is complete, then the method 100 proceeds to the heat step 104.

Figure 4:
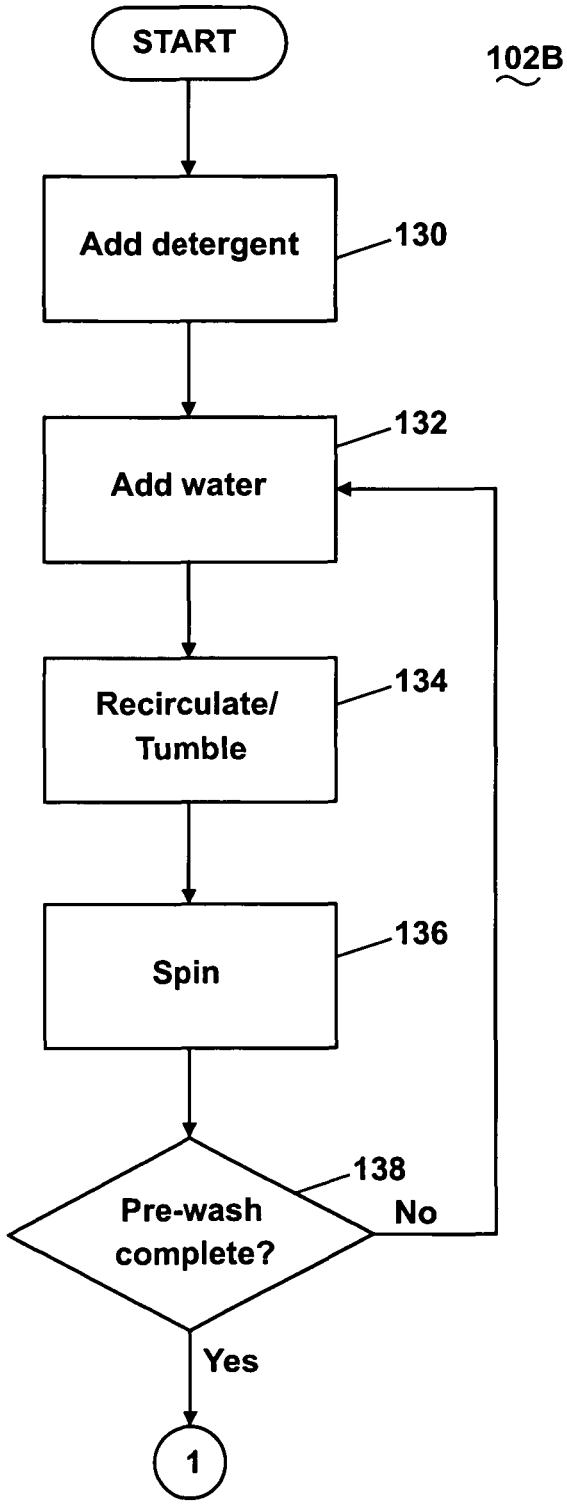
FIG. 4 is a flow chart of a second exemplary execution of the pre-wash step of the method of FIG. 2.

Referring now to FIG. 4, a second exemplary pre-wash step 102B begins with a user adding detergent to the washing machine 10 in step 130. The user can place the detergent in the detergent dispenser 32 or directly into the drum 16. Next, water is added in step 132 via the detergent dispenser 32 through the liquid conduit 36. Thus, if the user placed the detergent in the detergent dispenser 32, then the detergent flows with the water through the liquid conduit 36 in the step 132. The liquid from the liquid conduit 36 enters the tub 14 and flows to the sump 38. The water can be added to achieve a first volume of liquid. The achievement of the first volume of liquid can be determined on any suitable basis, such as by adding the water for a known period of time, by detecting a liquid level, such as a liquid level in the sump 38 with the liquid level sensor 52, or by detecting a volumetric flow rate of the water through the first supply conduit 30 or the liquid conduit 36. Regardless of how the achievement of the first volume of liquid is determined, the first volume of liquid can correspond to a predetermined liquid level in the sump 38 that is below the drum 16, as discussed above. An exemplary liquid level for the first volume of liquid is illustrated by the dashed line labeled L1 in FIG. 1.

In step 134, the pump 44 pumps the liquid from the sump 38 and through the recirculation conduit 48 to the recirculation inlet 50 to recirculate the liquid from the tub 14 to the drum 16, thereby wetting the fabric items in the drum 16 with the liquid. The step 134 also includes tumbling the drum 16, which can occur while the liquid is recirculating or after the liquid has been recirculated. Tumbling the drum 16 while the liquid recirculates advantageously moves the fabric items within the drum 16 whereby the recirculating liquid can be applied to the moving fabric items rather than to a stationary pile of the fabric items, which would be the case for the stationary drum 16. Applying the liquid to the moving fabric items can facilitate distributing the liquid among the fabric items, which absorb the recirculating liquid. An exemplary tumble speed for the pre-wash step 102A is about 40 rpm. The drum 16 can tumble in one direction only or can tumble in alternating directions.

The recirculation and tumbling of step 134 is followed by spinning the drum 16 in step 136. The spinning of the drum 16 forces the liquid absorbed by the fabric items to permeate through the fabric items and flow through the perforations 18 in the drum 16. While some of the liquid remains in the fabric items, the liquid that flows through the perforations 18 falls by gravity for collection in the sump 38. Exemplary spin speeds for the pre-wash step 102B are about 100 rpm and about 300 rpm. The drum 16 can spin in one direction only or can spin in alternating directions.

After the spinning step 134, a status of the pre-wash step 102B is evaluated at step 138. In particular, it is determined whether the pre-wash step 102B is complete. The completion of the pre-wash step 102B can be evaluated in any suitable manner, such as by the exemplary methods described above for the first exemplary pre-wash step 102A. If it is determined in step 138 that the pre-wash step 102B is not complete, then the pre-wash step 102B returns to the add water step 132 and repeats. As in the first exemplary pre-wash step 102B, the amount of water added during the add water step 132 can be an amount sufficient to compensate for the liquid absorbed by the fabric items and thereby maintain the first volume of liquid. If it is determined in step 138 that the pre-wash step 102B is complete, then the method 100 proceeds to the heat step 104.

Figure 5:
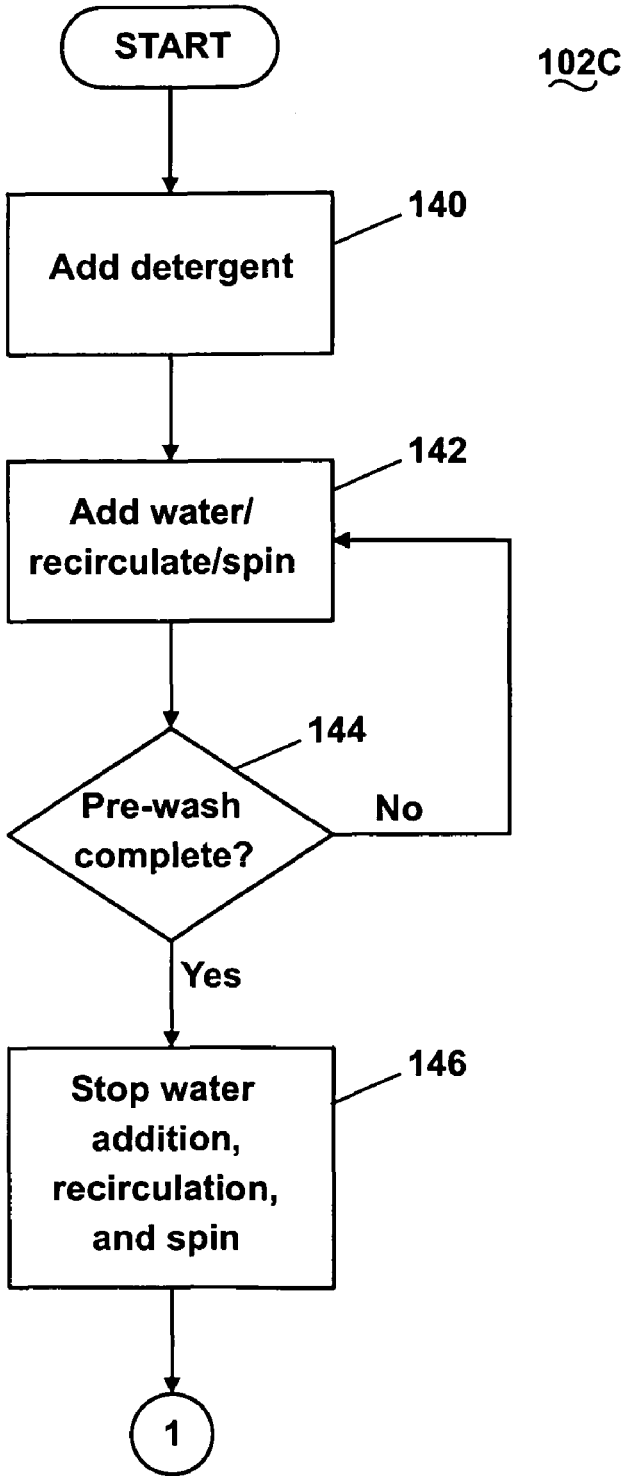
FIG. 5 is a flow chart of a third exemplary execution of the pre-wash step of the method of FIG. 2.

Referring now to FIG. 5, a third exemplary pre-wash step 102C begins with a user adding detergent to the washing machine 10 in step 140. The user can place the detergent in the detergent dispenser 32 or directly into the drum 16. Next, water is added in step 142 via the detergent dispenser 32 through the liquid conduit 36. Thus, if the user placed the detergent in the detergent dispenser 32, then the detergent flows with the water through the liquid conduit 36 in the step 142. The liquid from the liquid conduit 36 enters the tub 14 and flows to the sump 38. The water can be added to achieve a first volume of liquid. The achievement of the first volume of liquid can be determined on any suitable basis, such as by adding the water for a known period of time, by detecting a liquid level, such as a liquid level in the sump 38 with the liquid level sensor 52, or by detecting a volumetric flow rate of the water through the first supply conduit 30 or the liquid conduit 36. Regardless of how the achievement of the first volume of liquid is determined, the first volume of liquid can correspond to a predetermined liquid level in the sump 38 that is below the drum 16, as discussed above. An exemplary liquid level for the first volume of liquid is illustrated by a dashed line labeled L1 in FIG. 1.

In the step 142 of adding the water, the pump 44 pumps the liquid from the sump 38 and through the recirculation conduit 48 to the recirculation inlet 50 to recirculate the liquid from the tub 14 to the drum 16, thereby wetting the fabric items in the drum 16 with the liquid. The step 142 also includes spinning the drum 16, preferably while the liquid is recirculating. Spinning the drum 16 while the liquid recirculates advantageously distributes the fabric items around the drum 16 whereby the recirculating liquid can be applied to the distributed fabric items rather than to a stationary pile of the fabric items, which would be the case for the stationary drum 16. Exemplary spin speeds for the pre-wash step 102B are about 100 rpm and about 300 rpm. The drum 16 can spin in one direction only or can spin in alternating directions. The fabric items absorb the recirculating liquid that enters the drum 16, and the spinning of the drum 16 forces the liquid to permeate through the fabric items and flow through the perforations 18 in the drum 16. While some of the liquid remains in the fabric items, the liquid that flows through the perforations 18 falls by gravity to the sump 38 for entry into the recirculation conduit 48.

A status of the pre-wash step 102C is evaluated at step 144. In particular, it is determined whether the pre-wash step 102C is complete. The completion of the pre-wash step 102A can be evaluated in any suitable manner, such as by the exemplary methods described above for the first exemplary pre-wash step 102A.

One method of determining whether the fabric items are saturated that is particularly suitable for the step 144 of the pre-wash step 102C involves monitoring output from the liquid flow sensor 54 in the recirculation conduit 48. The liquid flow sensor 54 can be a pressure sensor whose output depends on the flow of liquid past the liquid flow sensor 54. When the fabric items are not saturated, the fabric items absorb a portion of the recirculating liquid; therefore, the liquid that flows through the perforations 18 and enters the recirculation conduit 48 has a reduced volume. Thus, the flow of the liquid past the liquid flow sensor 54 is not relatively constant (i.e., the volume of the liquid has been reduced as the fabric items absorb the liquid), and the output of the liquid flow sensor 54 is relatively unstable, which indicates that the fabric items are not sufficiently saturated and that the pre-wash step 102C is not complete. The output of the flow sensor 54 will inherently have some fluctuation, and the determination of whether the output is relatively unstable can be made, for example, by determining if the fluctuation of the output exceeds a predetermined amount of acceptable fluctuation. If it is determined in step 144 that the pre-wash step 102C is not complete, then the pre-wash step 102C returns to the add water/recirculate/spin step 142 and repeats. The amount of water added can be an amount sufficient to compensate for the liquid absorbed by the fabric items and thereby maintain the first volume of liquid. This can be accomplished, for example, by adding water until the output of the liquid flow sensor 54 becomes stable. When using this method of determining whether the fabric items are saturated, the steps 142 and 144 can be essentially a simultaneous process. For example, the recirculating of the liquid and the spinning of the drum 16 can be continuously executed while the water is added as needed, as determined by the step 144.

When the fabric items are saturated, the liquid that permeates through the fabric items, flows through the perforations 18, and enters the recirculation conduit 48 does not exhibit a reduction in volume. Thus, the flow of the liquid past the liquid flow sensor 54 is relatively constant, and the output of the liquid flow sensor 54 is relatively stable. As a result, the relatively stable reading from the liquid flow sensor 54 without a corresponding introduction of water to maintain the stable reading indicates that the fabric items are sufficiently saturated and that the pre-wash step 102C is complete. As stated above, the output of the flow sensor 54 will inherently have some fluctuation, and the determination of whether the output is relatively stable can be made, for example, by determining if the fluctuation of the output is within the predetermined amount of acceptable fluctuation.

As stated above, the liquid flow sensor 54 can be any suitable device for detecting liquid flow. For example, the liquid flow sensor 54 can comprise a pressure sensor, a flow meter, or a float switch. The flow meter can detect a flow rate or a volume of liquid.

Once it is determined in step 144 that the pre-wash step 102C is complete, then the water addition, the recirculation of the liquid, and the spinning of the drum 16 stop in step 146, and the method 100 proceeds to the heat step 104.

Figure 6:
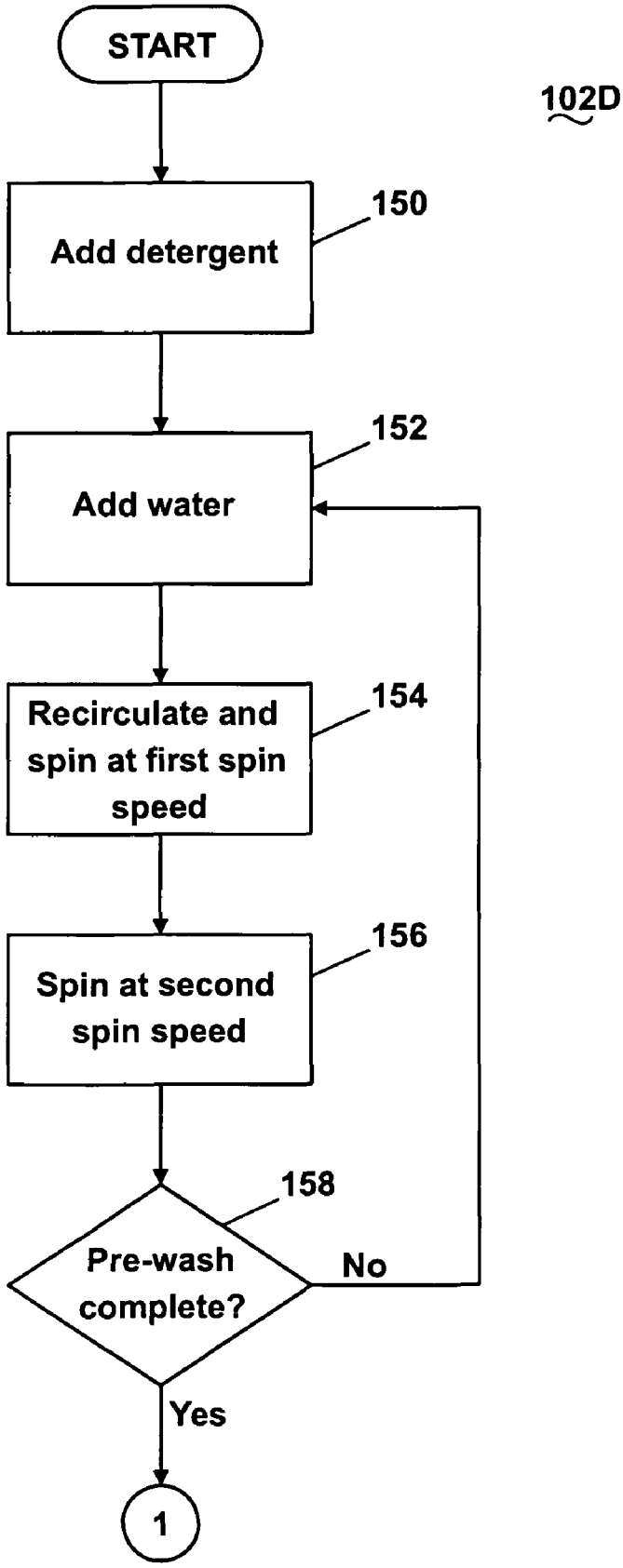
FIG. 6 is a flow chart of a fourth exemplary execution of the pre-wash step of the method of FIG. 2.

Referring now to FIG. 6, a fourth exemplary pre-wash step 102D begins with a user adding detergent to the washing machine 10 in step 150. The user can place the detergent in the detergent dispenser 32 or directly into the drum 16. Next, water is added in step 152 via the detergent dispenser 32 through the liquid conduit 36. Thus, if the user placed the detergent in the detergent dispenser 32, then the detergent flows with the water through the liquid conduit 36 in the step 152. The liquid from the liquid conduit 36 enters the tub 14 and flows to the sump 38. The water can be added to achieve a first volume of liquid. The achievement of the first volume of liquid can be determined on any suitable basis, such as by adding the water for a known period of time, by detecting a liquid level, such as a liquid level in the sump 38 with the liquid level sensor 52, or by detecting a volumetric flow rate of the water through the first supply conduit 30 or the liquid conduit 36. Regardless of how the achievement of the first volume of liquid is determined, the first volume of liquid can correspond to a predetermined liquid level in the sump 38 that is below the drum 16, as discussed above. An exemplary liquid level for the first volume of liquid is illustrated by the dashed line labeled L1 in FIG. 1.

In step 154, the pump 44 pumps the liquid from the sump 38 and through the recirculation conduit 48 to the recirculation inlet 50 to recirculate the liquid from the tub 14 to the drum 16, thereby wetting the fabric items in the drum 16 with the liquid. The step 154 also includes spinning the drum 16 at a first spin speed, which can occur while the liquid is recirculating or after the liquid has been recirculated. Spinning the drum 16 at the first spin speed while the liquid recirculates advantageously distributes the fabric items around the drum 16 whereby the recirculating liquid can be applied to the distributed fabric items rather than to a stationary pile of the fabric items, which would be the case for the stationary drum 16. The first spin speed can be a relatively low spin speed sufficient to distribute the fabric items about the drum 16, and an exemplary spin speed for the first spin speed is about 100 rpm. The drum 16 can spin in one direction only or can spin in alternating directions at the first spin speed.

After the spinning of the drum 16 at the first spin speed, the drum 16 spins at a second spin speed greater than the first spin speed in step 156. The recirculation of the liquid during the step 154 can cease prior to the spinning of the drum 16 at the second spin speed, or, alternatively, it can continue during the spinning of the drum 16 at the second spin speed. The second spin speed can be a relatively high spin speed sufficient to force the recirculating liquid that enters the drum 16 to permeate through the fabric items and flow through the perforations 18 in the drum 16, and an exemplary spin speed for the second spin speed is a speed greater than about 250 rpm, such as about 280 rpm or about 300 rpm. The drum 16 can spin in one direction only or can spin in alternating directions at the second spin speed. While some of the liquid remains in the fabric items, the liquid that flows through the perforations 18 falls by gravity for collection in the sump 38.

Although not shown in FIG. 6, the recirculation and spinning of the steps 154 and 156 can be optionally followed by tumbling the drum 16, similar to tumbling step 126 in the pre-wash step 102A of FIG. 3.

A status of the pre-wash step 102D is evaluated at step 158. In particular, it is determined whether the pre-wash step 102D is complete. The completion of the pre-wash step 102D can be evaluated in any suitable manner, such as by the exemplary methods described above for the first exemplary pre-wash step 102A or by the exemplary method described above with respect to the third exemplary pre-wash step 102C.

If it is determined in step 158 that the pre-wash step 102D is not complete, then the pre-wash step 102D returns to the add water step 152 and repeats. During the add water step 152, the amount of water added can be an amount sufficient to compensate for the liquid absorbed by the fabric items and thereby maintain the first volume of liquid. If it is determined in step 158 that the pre-wash step 102D is complete, then the method 100 proceeds to the heat step 104.

Figure 7:
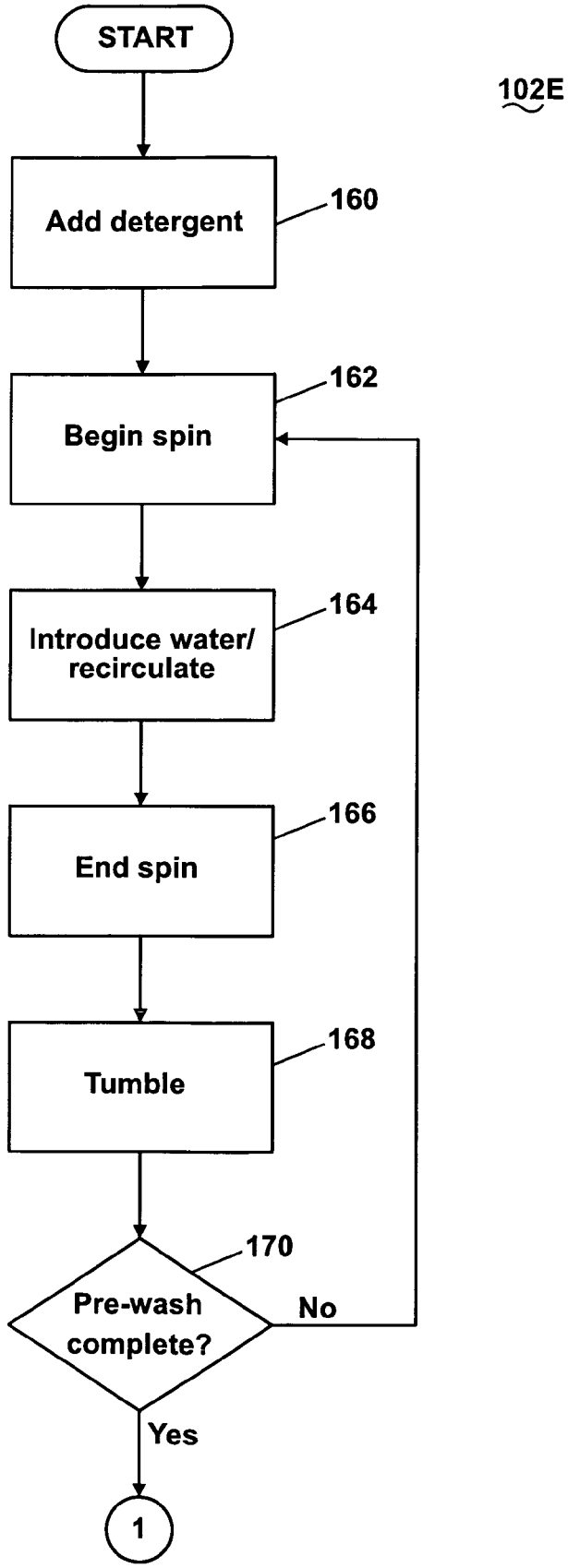
FIG. 7 is a flow chart of a fifth exemplary execution of the pre-wash step of the method of FIG. 2.

Referring now to FIG. 7, a fifth exemplary pre-wash step 102E begins with a user adding detergent to the washing machine 10 in step 120. The user can place the detergent in the detergent dispenser 32 or directly into the drum 16. In the pre-wash step 102E, it is critical that the fabric items are placed in the drum 16 before, during, or immediately after the step 160 of adding the detergent.

With the fabric items in the drum 16, the drum 16 begins to spin at step 162. During the spinning of the drum 16 at the step 162, liquid has not yet been introduced into the drum 16. As a result, the fabric items are either dry or contain only liquid that was already present in the fabric items prior to the placement of the fabric items in the drum 16. The spinning of the drum 16 prior to introduction of liquid distributes the fabric items about the drum 16 to facilitate uniform introduction of liquid in subsequent step 164. The drum 16 can spin at any suitable spin speed, such as about 100 rpm, in either one direction or alternating directions.

In the step 164, water is added via the detergent dispenser 32 through the liquid conduit 36. Thus, if the user placed the detergent in the detergent dispenser 32, then the detergent flows with the water through the liquid conduit 36 in the step 164. The liquid from the liquid conduit 36 enters the tub 14 and flows to the sump 38. The water can be added to achieve a first volume of liquid. The achievement of the first volume of liquid can be determined on any suitable basis, such as by adding the water for a known period of time, by detecting a liquid level, such as a liquid level in the sump 38 with the liquid level sensor 52, or by detecting a volumetric flow rate of the water through the first supply conduit 30 or the liquid conduit 36. Regardless of how the achievement of the first volume of liquid is determined, the first volume of liquid can correspond to a predetermined liquid level in the sump 38 that is below the drum 16, as discussed above. An exemplary liquid level for the first volume of liquid is illustrated by the dashed line labeled L1 in FIG. 1.

With the drum 16 continuing to spin, the liquid recirculates and is introduced into the drum 16 to wet the distributed fabric items. In particular, the pump 44 pumps the liquid from the sump 38 and through the recirculation conduit 48 to the recirculation inlet 50 to recirculate the liquid from the tub 14 to the drum 16, thereby wetting the fabric items in the drum 16 with the liquid. During the recirculation of the liquid, the drum 16 can continue to spin at the same speed as during the step 162, or the spin speed can be increased. The fabric items absorb the recirculating liquid that enters the drum 16, and the spinning of the drum 16 forces the liquid to permeate through the fabric items and flow through the perforations 18 in the drum 16. While some of the liquid remains in the fabric items, the liquid that flows through the perforations 18 falls by gravity for collection in the sump 38. The spinning of the drum 16 ceases at step 166, which can be coincident with the end of the step 164 (i.e., the spinning stops when the recirculation stops) or extend beyond the end of the step 164 (i.e., the spinning continues after the recirculation stops).

The recirculation and spinning of the steps 164, 166 can be optionally followed by tumbling the drum 16 in step 168. When the drum 16 tumbles, the fabric items fall back to the lowest location of the drum 16 and can be redistributed amongst each other. An exemplary tumble speed for the pre-wash step 102E is about 40 rpm. The drum 16 can tumble in one direction only or can tumble in alternating directions.

After the optional tumbling step 168, a status of the pre-wash step 102E is evaluated at step 170. In particular, it is determined whether the pre-wash step 102E is complete. The completion of the pre-wash step 102E can be evaluated in any suitable manner, such as by the exemplary methods described above for the first exemplary pre-wash step 102A or by the exemplary method described above with respect to the third exemplary pre-wash step 102C.

If it is determined in step 170 that the pre-wash step 102E is not complete, then the pre-wash step 102E returns to the begin spin step 162 and repeats. During the introduction of water in the step 164, the amount of water added can be an amount sufficient to compensate for the liquid absorbed by the fabric items and thereby maintain the first volume of liquid. If it is determined in step 170 that the pre-wash step 102E is complete, then the method 100 proceeds to the heat step 104.

Switching focus to the heat step 104, steam is introduced to heat the fabric items, which are in a wet condition due to the pre-wash step 102. The steam increases the temperature of the fabric load and the liquid absorbed by the fabric load. The steam can also heat any liquid present in the drum 16, tub 14, sump 38, and recirculation conduit 48. The addition of heat facilitates removal of soil from the fabric load. The heat step 104 can proceed for a predetermined period of time or until the fabric load or liquid in the washing machine 10 reaches a predetermined temperature, which can be measured by a temperature sensor. The predetermined temperature can depend on several factors, such as size and type of the fabric items and wash cycle selected by the user. An exemplary predetermined temperature is about 60° C.

The introduction of steam can be accompanied by rotation of the drum 16. For example, the drum 16 can tumble during the entire period of steam introduction or during a portion of the steam introduction period. Alternatively, the introduction of steam and the rotation of the drum 16 can occur in an alternating fashion. The tumbling of the drum 16 moves the fabric items within the drum 16 and facilitates distribution of the steam among the fabric items for uniform heating of the fabric items and the liquid absorbed by the fabric items. Furthermore, the rotation of the drum 16 helps to retain the steam in the drum 16 for effective and uniform heating.

Figure 8:
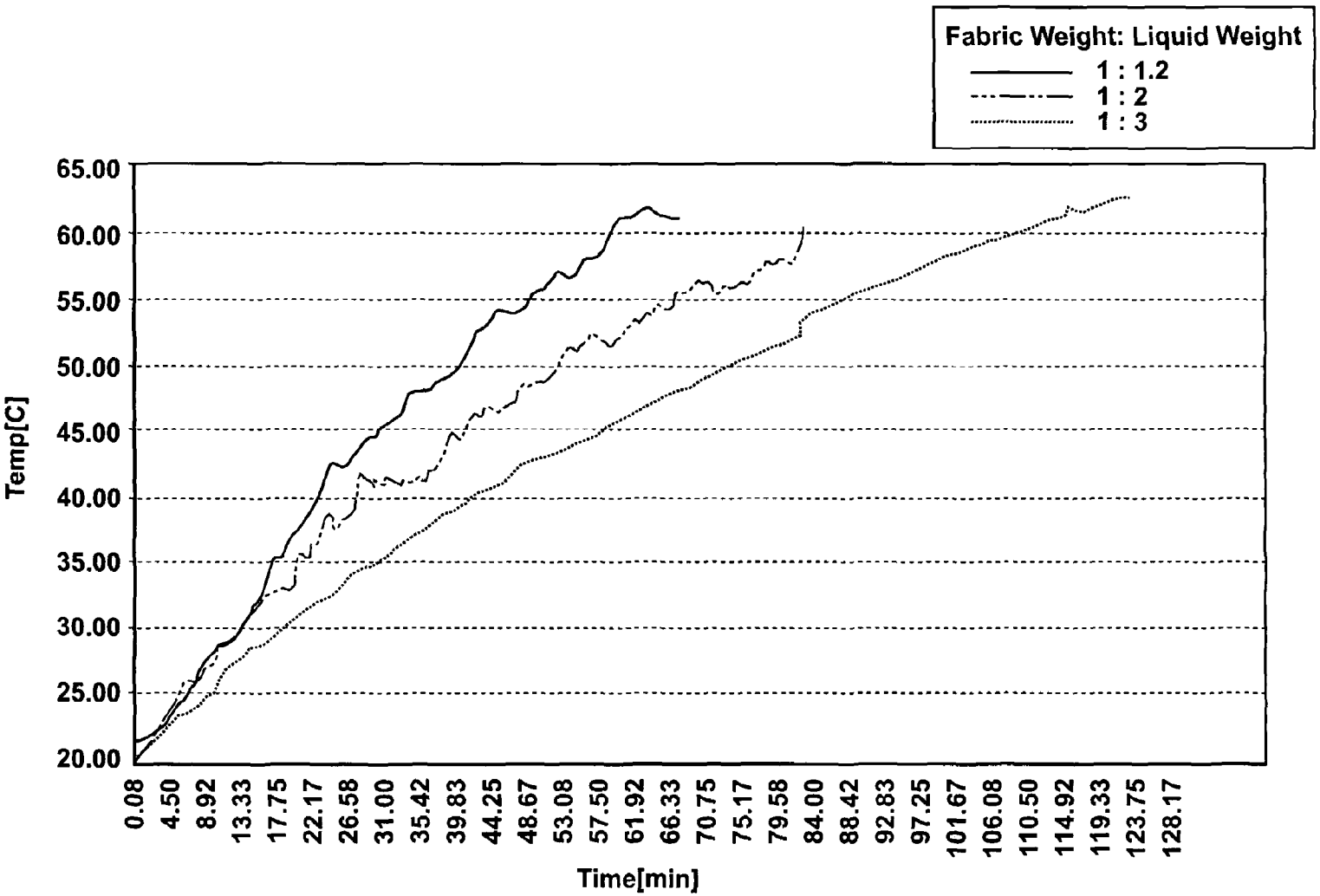
FIG. 8 is a graph illustrating a relationship between heating time and ratio of fabric weight to liquid weight for the heat step of the method of FIG. 2.

According to one embodiment, the heat step 104 heats the fabric items and the liquid absorbed by the fabric items relatively quickly due to the relatively small amount of liquid absorbed by the fabric items (i.e., relatively high fabric weight to liquid weight ratio). FIG. 8 graphically illustrates the relationship between heating time and the ratio of fabric weight to liquid weight. As the liquid weight increases (i.e., the ratio decreases), time required to achieve a given temperature also increases. Thus, not only does utilizing a low amount of liquid reduce water consumption, but it also corresponds to a reduced power consumption during heating because the steam generator 60 functions for a reduced duration.

Figure 9:
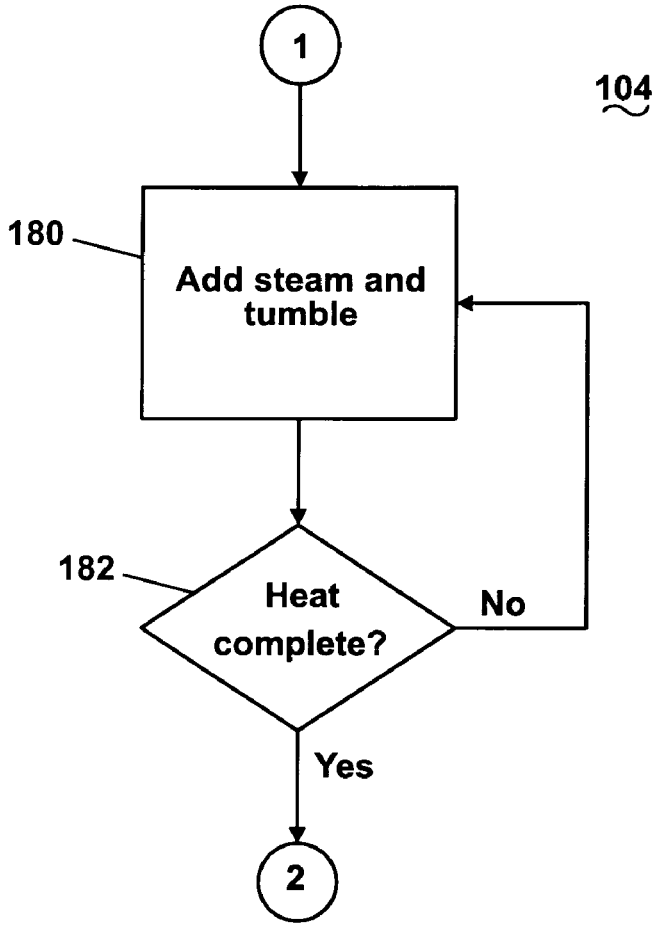
FIG. 9 is a flow chart of an exemplary execution of the heat step of the method of FIG. 2.

An exemplary execution of the heat step 104 is illustrated in flow chart in FIG. 9. A description of the exemplary execution follows, with it being understood that the flow chart and description are provided for illustrative purposes only. It is within the scope of the invention for the heat step 104 to differ from the exemplary execution of FIG. 9. The exemplary execution is described with respect to the exemplary washing machine 10 in FIG. 1, but it is within the scope of the invention to utilize other washing machines.

Referring now to FIG. 9, the heat step 104 comprises a step 180 of adding steam and tumbling. To introduce steam, liquid enters the first liquid inlet 28 and flows through the second inlet valve 64 in the second supply conduit 62 to the steam generator 60. The steam generator converts the liquid to steam, which flows through the steam conduit 66 to the steam inlet 68, where the steam enters the tub 14. The steam disperses from the steam inlet 68 and flows through the perforations 18 into the drum 16, where it heats the fabric load and the liquid absorbed by the fabric load. The steam can also heat any liquid present in the tub 14 or other component of the liquid supply and recirculation system.

As discussed above, the tumbling of the drum 16 is optional and need not occur simultaneously with the introduction of steam. An exemplary tumble speed for the step 180 of the heat step 104 is about 40 rpm. The drum 16 can tumble in one direction only or can tumble in alternating directions.

A status of the heat step 104 is evaluated at step 182, which can occur continuously or at regular intervals during the execution of the step 180 of heating and optional tumbling. In particular, it is determined whether the heat step 104 is complete. The completion of the heat step 104 can be evaluated in any suitable manner, such as by determining if the predetermined time has elapsed or if the predetermined temperature has been achieved. If it is determined in step 182 that the heat step 104 is not complete, then the step 180 of heating and optional tumbling continues. If it is determined in step 182 that the heat step 104 is complete, then the method 100 proceeds to the wash step 106.

The flow charts of FIGS. 2 and 9 indicate that the heat step 104 occurs after the pre-wash step 102 and before the wash step 106. However, it is within the scope of the invention to incorporate the heat step 104 into the pre-wash step 102 and/or the wash step 106 and does not necessarily have to exist as a distinct step between the pre-wash step 102 and the wash step 106.

The wash step 106 utilizes a greater volume of liquid than the pre-wash step 102 to lift soils, spots, stains, debris, and the like from the fabric items. The pre-wash step 102 employs the concentrated detergent solution to chemically treat the fabric items, and the greater volume of liquid for the wash step 106 provides sufficient free liquid to lift the soils from the chemically treated fabric items. The addition of heat during the heat step 104 facilitates the washing of the fabric items, as it is well-known that heat improves cleaning performance. The liquid for the wash step 106 can be formed by a combination of the liquid remaining in the tub 14 and/or drum 16 after the pre-wash step 102 and additional, new liquid. In this case, the new liquid dilutes the detergent solution. According to one embodiment, for example, the concentration of the detergent solution when diluted can approach or equal a concentration of detergent solution utilized during a conventional wash cycle. Alternatively, the liquid for the pre-wash step 102 can be drained, and the wash step 106 can be formed entirely by new liquid.

One manner of quantifying the amount of liquid used in the wash step 106 is the ratio of fabric weight to liquid weight. Exemplary ratios for the wash step 106 are ratios less than the ratio achieved during the pre-wash step 102. Exemplary suitable ranges for the ratio in the pre-wash step 102 were given above as from about 1:0.5 to 1:2.7 or 1:0.5 to 1:2.3. Exemplary suitable ranges for the ratio in the wash step 106 are ratios less than about 1:2.7 or less than about 1:2.3. For example, given the ratio of about 1:1.15 for the pre-wash step 102, an illustrative ratio for the wash step 106 is about 1:3.4.

Another manner of quantifying the amount of liquid used in the wash step 106 involves comparing of the volume of liquid with structural features of the washing machine 10. For example, the volume of liquid can be a volume that submerges at least a portion of the drum 16. By submerging at least a portion of the drum 16 with the liquid, the wash step 106 can include rotating the drum 16 through the liquid to accomplish the washing of the fabric items. Some washing machines, however, include a recirculation inlet that sprays the liquid onto the clothing for washing rather than rotating the drum through the liquid. In such washing machines, the volume of liquid can be a volume that does not submerge any portion of the drum 16. As discussed previously, keeping the volume of liquid below the drum 16 prevents sudslock when the drum 16 spins.

The wash step 106 can proceed in any suitable manner and is not limited to any particular actions. For example, the wash step 106 can include one or more of the following actions: add liquid, recirculate liquid, rotating the drum by tumbling and/or spinning, and draining liquid. The actions can occur any number of times and in any sequence.

Figure 10:
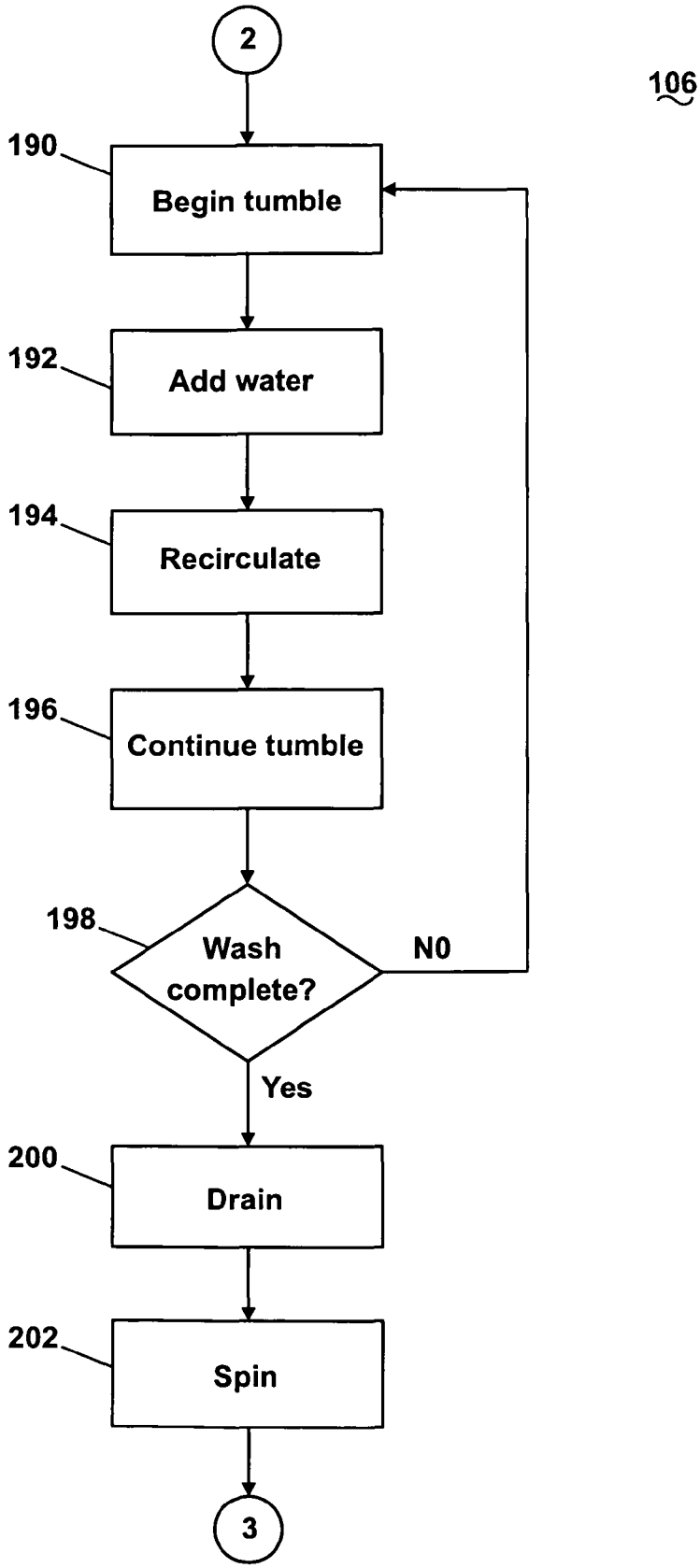
FIG. 10 is a flow chart of an exemplary execution of the wash step of the method of FIG. 2.

An exemplary execution of the wash step 106 is illustrated in flow chart in FIG. 10. A description of the exemplary execution follows, with it being understood that the flow chart and description are provided for illustrative purposes only. It is within the scope of the invention for the wash step 106 to differ from the exemplary execution of FIG. 10. The exemplary execution is described with respect to the exemplary washing machine 10 in FIG. 1, but it is within the scope of the invention to utilize other washing machines.

Referring now to FIG. 10, the wash step 106 begins with tumbling the drum 16 at step 190. An exemplary tumble speed for the wash step 106 is about 40 rpm. The drum 16 can tumble in one direction only or can tumble in alternating directions. While the drum 16 continues to tumble, water is added in step 192 to reach a second volume of liquid greater than the first volume of liquid from the pre-wash step 102. In the exemplary execution of FIG. 10, the second volume of liquid is formed by adding the water to the first volume of liquid already present in the tub 14 and/or drum 16. Thus, the addition of the water to the first volume of liquid dilutes the detergent solution to form the second volume of liquid. In the exemplary execution, the second volume of liquid submerges at least a portion of the drum 16. In step 194, the liquid recirculates while the drum 16 continues to tumble. Recirculation of the liquid ensures that the detergent in the second volume of liquid is evenly distributed within the liquid and that all the fabric items are wet with the liquid. After recirculation of the liquid, the drum 16 continues to tumble in step 196. During the tumbling of the drum 16, the drum 16 rotates through the second volume of liquid to facilitate washing of the fabric items.

A status of the wash step 106 is evaluated at step 198, which can occur while the drum 16 continues to tumble. In particular, it is determined whether the wash step 106 is complete. The completion of the wash step 106 can be evaluated in any suitable manner, such as by determining if a predetermined time has elapsed. If it is determined in step 198 that the wash step 106 is not complete, then the wash step 106 returns to the begin tumble step 190 and repeats. As the wash step 106 repeats, water can be added to maintain the second volume of liquid during the add water step 192, if necessary. If it is determined in step 198 that the wash step 106 is complete, then the wash step 106 concludes with a draining of the liquid through the drain conduit 46 in step 200 and a spinning of the drum 16 in step 202 to extract liquid from the fabric items. The tumbling of the drum 16 can cease prior to the draining step 200, or the tumbling of the drum 16 can continue through the draining step 200, whereby the rotational speed of the drum 16 increases for the subsequent spinning of the drum 16 in the step 202. Thereafter, the method 100 proceeds to the rinse step 108.

Figure 11:
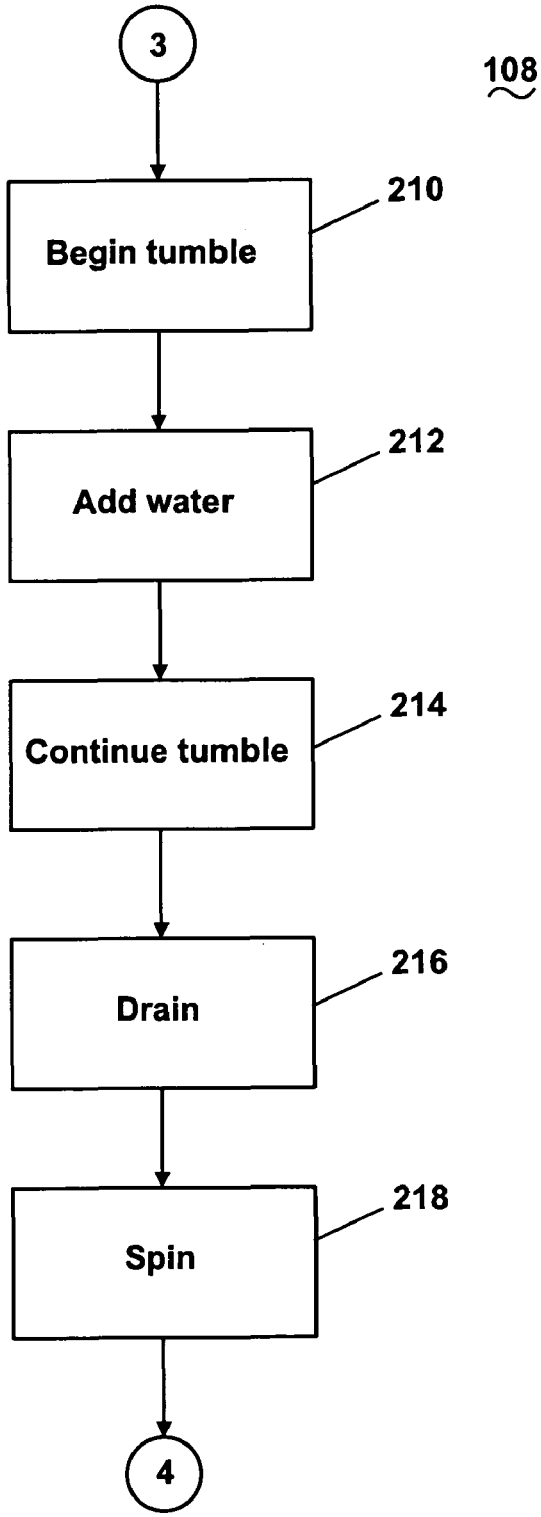
FIG. 11 is a flow chart of an exemplary execution of the rinse step of the method of FIG. 2.

The rinse step 108 that follows the wash step 106 can be any suitable step for rinsing the detergent solution from the fabric items. An exemplary execution of the rinse step 108 is shown in the flow chart of FIG. 11. The exemplary execution begins with tumbling the drum 16 at step 210 and adding water in step 212 while the drum 16 continues to tumble. According to the exemplary execution, the amount of water added to the drum 16 submerges at least a portion of the drum 16. As a result, after the water has been added, the drum 16 continues to tumble at step 214, whereby the drum 16 rotates through the water to rinse the fabric items. After a predetermined period of time, the water drains at step 216, and the rinse step 108 concludes with a spinning of the drum 16 to extract liquid from the fabric items. Thereafter, the method 100 proceeds to the extract step 110.

Figure 12:
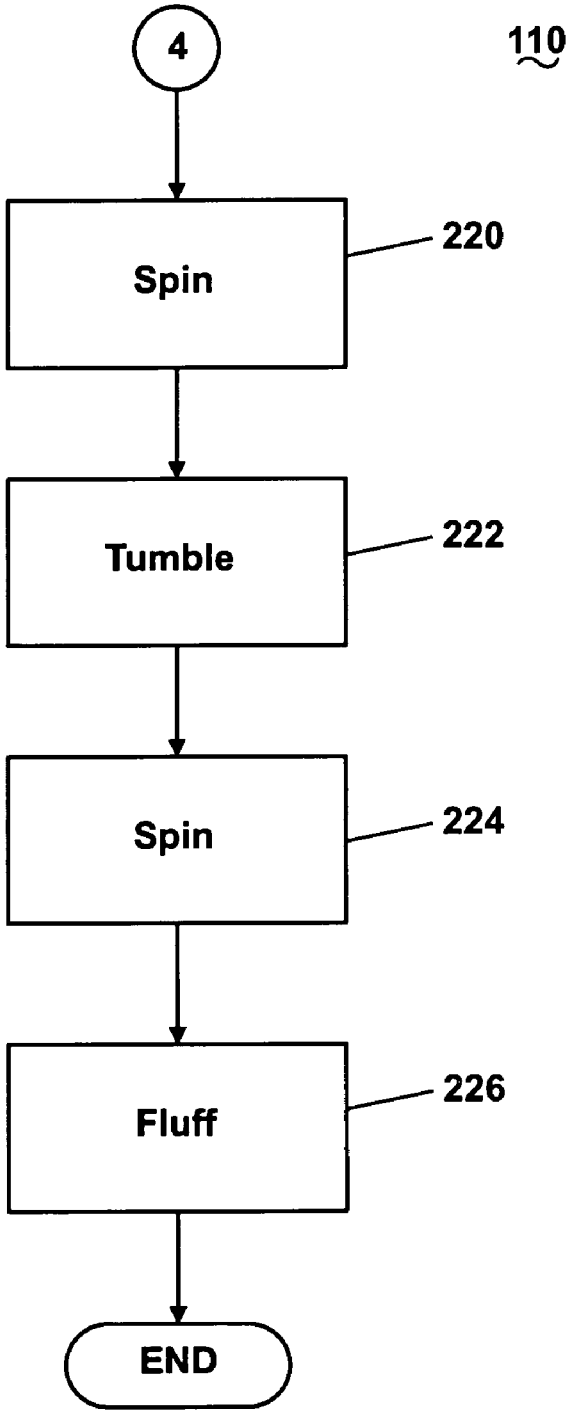
FIG. 12 is a flow chart of an exemplary execution of the extract step of the method of FIG. 2.

The extract step 110 that follows the rinse step 108 can be any suitable step for extracting liquid from the fabric items. An exemplary execution of the extract step 110 is shown in the flow chart of FIG. 12. The exemplary execution begins with spinning the drum 16 at step 220. After a predetermined period of time, the rotational speed of the drum 16 decreases to tumble the drum 16 at step 222. The tumbling of the drum 16 enables the fabric items to be redistributed prior to another step 224 of spinning the drum 16. After another predetermined period of time, the spinning of the drum 16 ceases, and the drum 16 rotates to fluff the fabric items in step 226. The method 100 ends with the fluff step 226.

While the method 100 has been described as comprising the pre-wash step 102, the heat step 104, the wash step 106, the rinse step 108, and the extract step 110, it is within the scope of the invention for the method 100 to include only one or a subset of the steps 102, 104, 106, 108, 110 or to include additional steps. Furthermore, the steps 102, 104, 106, 108, 110 can be conducted in any suitable order and can be repeated if deemed necessary.

Figure 13:
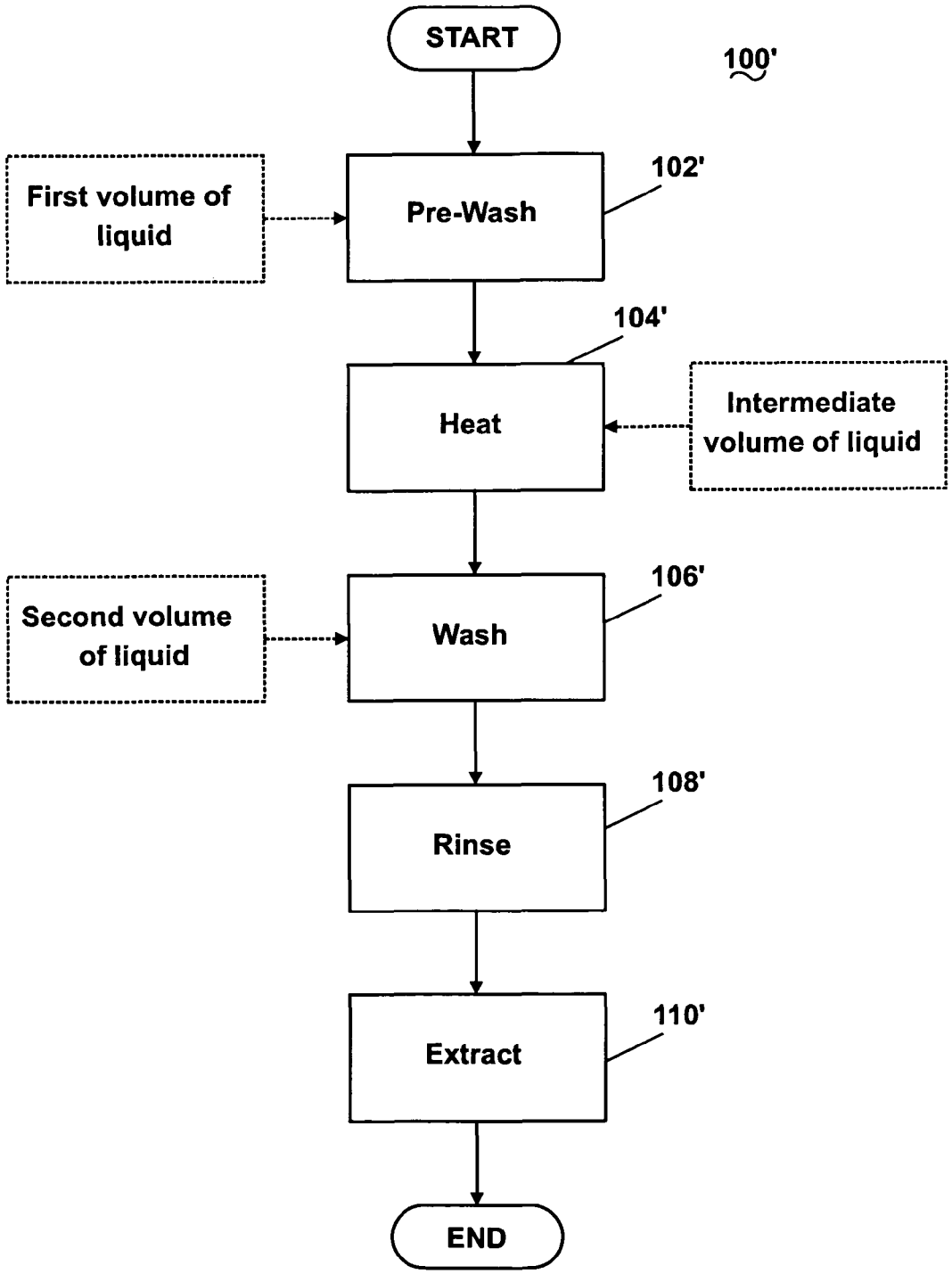
FIG. 13 is a flow chart of an alternative method of operating a steam washing machine according to one embodiment of the invention.

An alternative method 100' of operating a washing machine with steam according to one embodiment of the invention is illustrated in FIG. 13, where method steps similar to those of the first embodiment method 100 of FIG. 2 are identified with the same reference numeral bearing a prime (') symbol. The alternative method 100' is substantially identical to the first embodiment method 100, except that the heat step 104' in the former employs an intermediate volume of liquid greater than the first volume of liquid but less than the second volume of liquid.

The heat step 104' can include adding water to increase the volume of liquid from the first volume of liquid to the intermediate volume of liquid. The additional liquid facilitates lifting of the stains as the fabric items and the liquid absorbed by the fabric items are heated during the heat step 104'. However, because the intermediate volume of liquid can hold more heat than the first volume of liquid, the steam generator 60 utilizes more power to produce enough steam to heat the intermediate volume of liquid. Consequently, these factors should be weighed against one another when selecting the intermediate volume of liquid.

As discussed above with respect to the first and second volumes of liquid, one manner of quantifying the amount of liquid for the intermediate volume of liquid is the ratio of fabric weight to liquid weight. Exemplary ratios for the heat step 104' are ratios less than the ratio achieved during the pre-wash step 102' but greater than that of the wash step 106'. For example, given the ratios of about 1:1.12 for the pre-wash step 102' and about 1:3.4 for the wash step 106', an illustrative ratio for the heat step 104' is about 1:1.7.

Another manner of quantifying the amount of liquid for the intermediate volume of liquid involves comparing of the volume of liquid with structural features of the washing machine 10. For example, the intermediate volume of liquid can be a volume that submerges at least a portion of the drum 16. Alternatively, the intermediate volume of liquid can be a volume that does not submerge any portion of the drum 16.

As an alternative, the method 100' can utilize the first volume of liquid during the pre-wash step 102' and the heat step 104', the second volume of liquid during the wash step 106', and the intermediate volume of liquid during a rotate step between the heat step 104' and the wash step 106'. The rotate step can comprise tumbling or spinning the drum 16. Optionally, the rotate step can be considered as an additional pre-wash step that includes addition of a wash aid. For example, detergent can be added during the pre-wash step 102', and a different wash aid, such as bleach, can be added during the additional pre-wash step. Adding the bleach after the detergent ensures that the bleach does not harm the performance of the detergent.

As mentioned above, the method 100, 100' can be executed and adapted for use with any suitable type of horizontal axis or vertical axis washing machine. The washing machine shown in FIG. 1 and described above has been provided for illustrative purposes. The liquid supply and recirculation system and the steam generation system can differ from that of the washing machine 10 in FIG. 1. Variations of the liquid supply and recirculation system and the steam generation system are presented below with respect to FIGS. 14-18. The structures in FIGS. 14-18 can be combined in any desirable manner to configure the liquid supply and recirculation system and the steam generation system.

Figure 14:
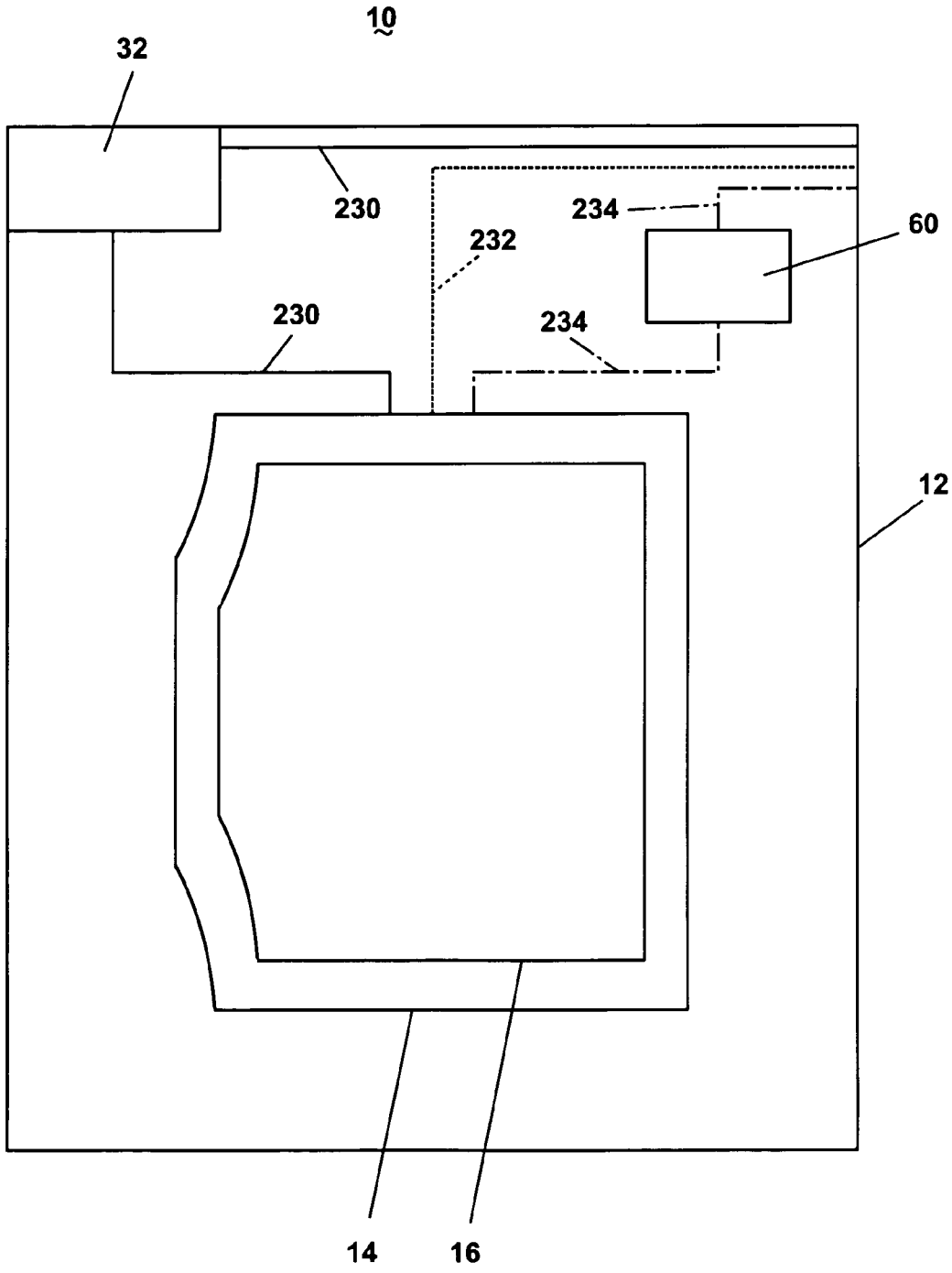
FIG. 14 is a schematic view of the washing machine of FIG. 1 with alternative structures for introducing liquid into a tub of the washing machine according to one embodiment of the invention.
Figure 15:
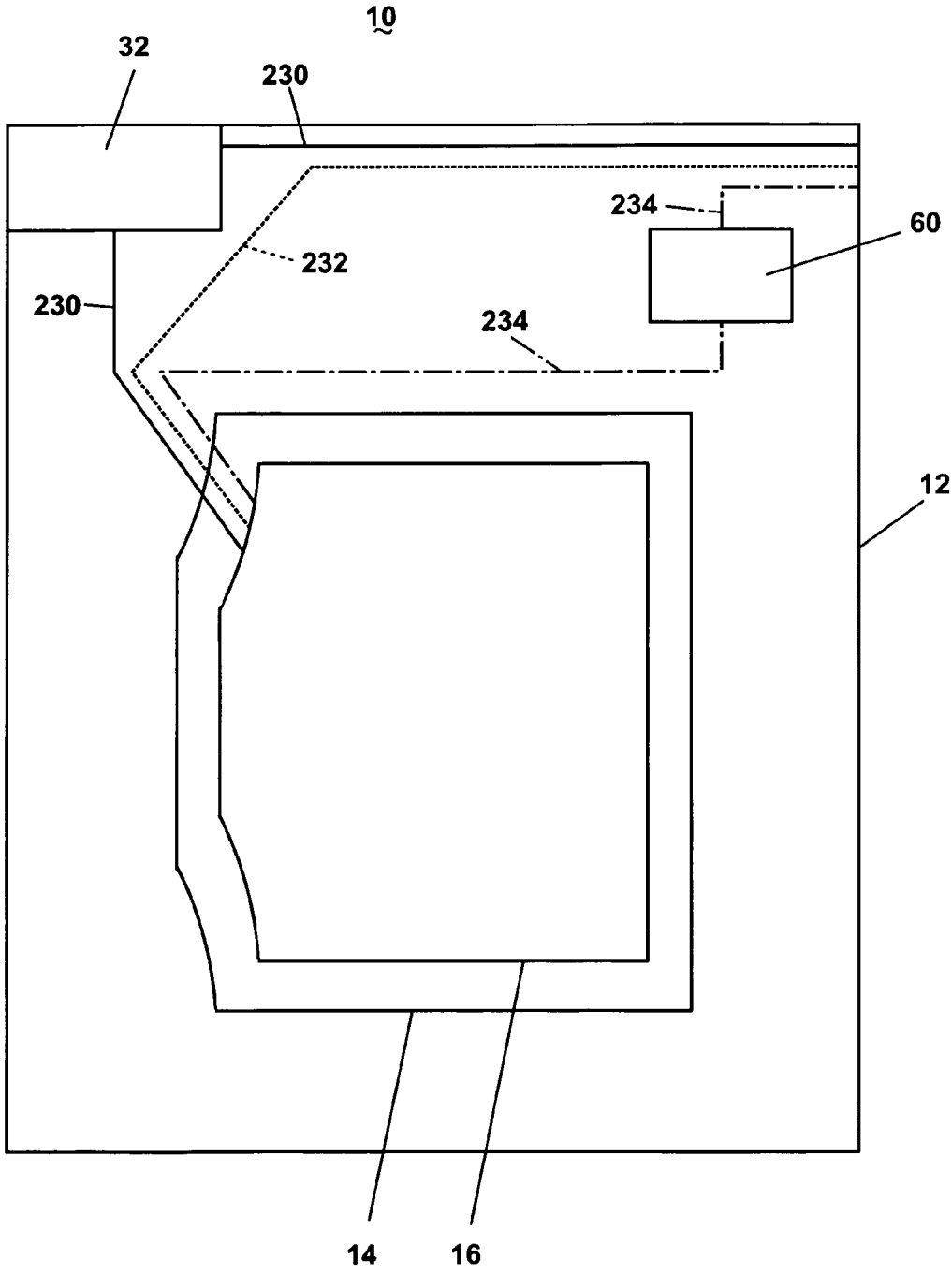
FIG. 15 is a schematic view of the washing machine of FIG. 1 with alternative structures for introducing liquid into a drum of the washing machine according to one embodiment of the invention.

Alternative structures for introducing liquid into the tub 14 and drum 16 are illustrated schematically in FIGS. 14 and 15. Referring particularly to FIG. 14, the liquid can be supplied from an external source through the detergent dispenser 32 to the tub 14, as shown by a solid line 230, directly from the external source to the tub 14, as shown by a dotted line 232, and from the external source through the steam generator 60 to the tub 14, as shown by a dash-dot-dash line 234. The inlet for supplying the liquid to the tub 14 can be positioned in any suitable location and is illustrated as along an upper wall of the tub 14 in FIG. 14 for exemplary purposes. Alternatively, the liquid can be supplied directly to the drum 16 rather than to the tub 14, as depicted in FIG. 15. The inlet for supplying the liquid to the drum 16 can be positioned in any suitable location and is illustrated as along a front wall of the drum 16 in FIG. 15 for exemplary purposes.

Figure 16:
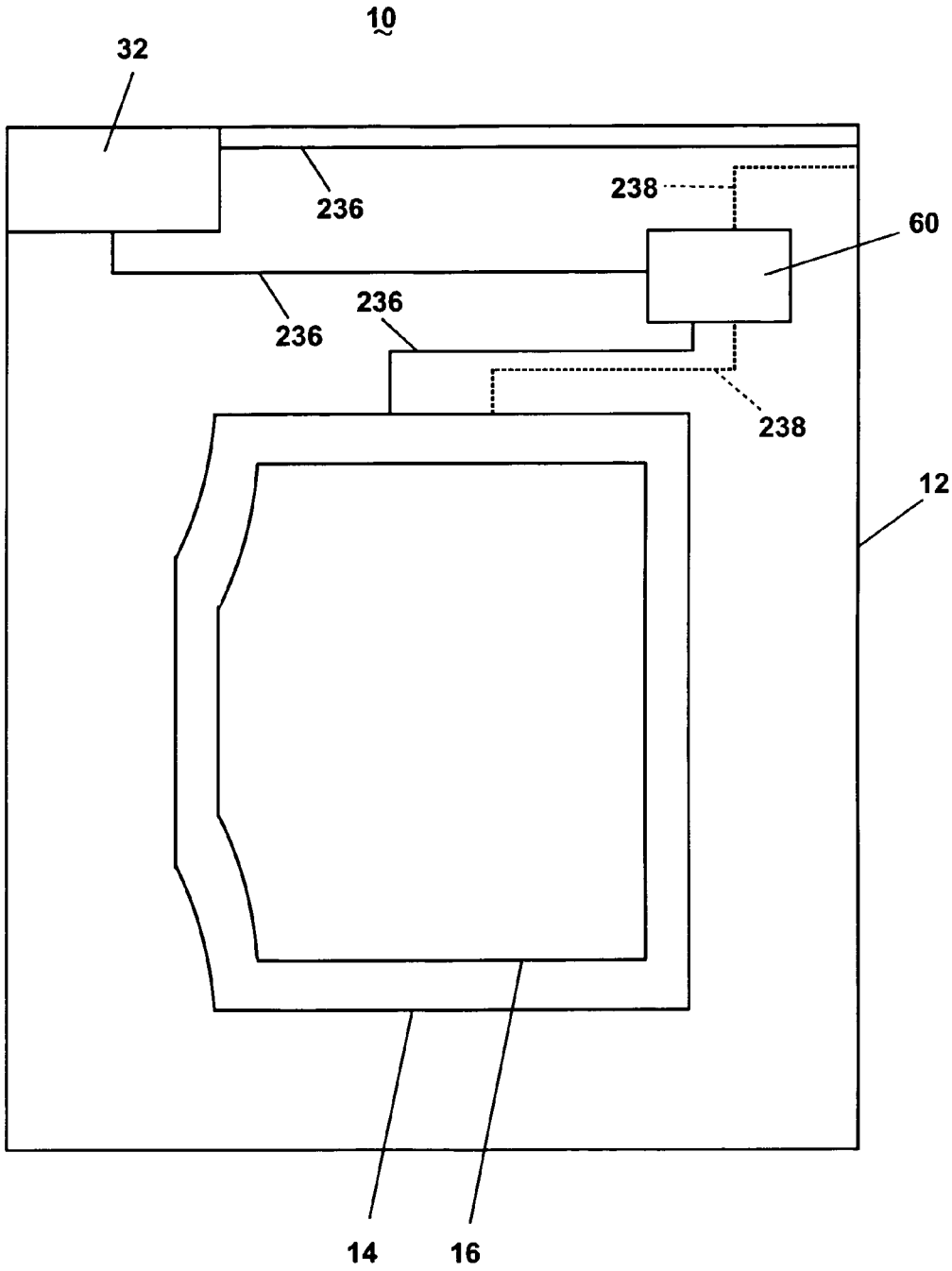
FIG. 16 is a schematic view of the washing machine of FIG. 1 with alternative structures for introducing liquid into a steam generator of the washing machine and for introducing steam into the tub of the washing machine according to one embodiment of the invention.
Figure 17:
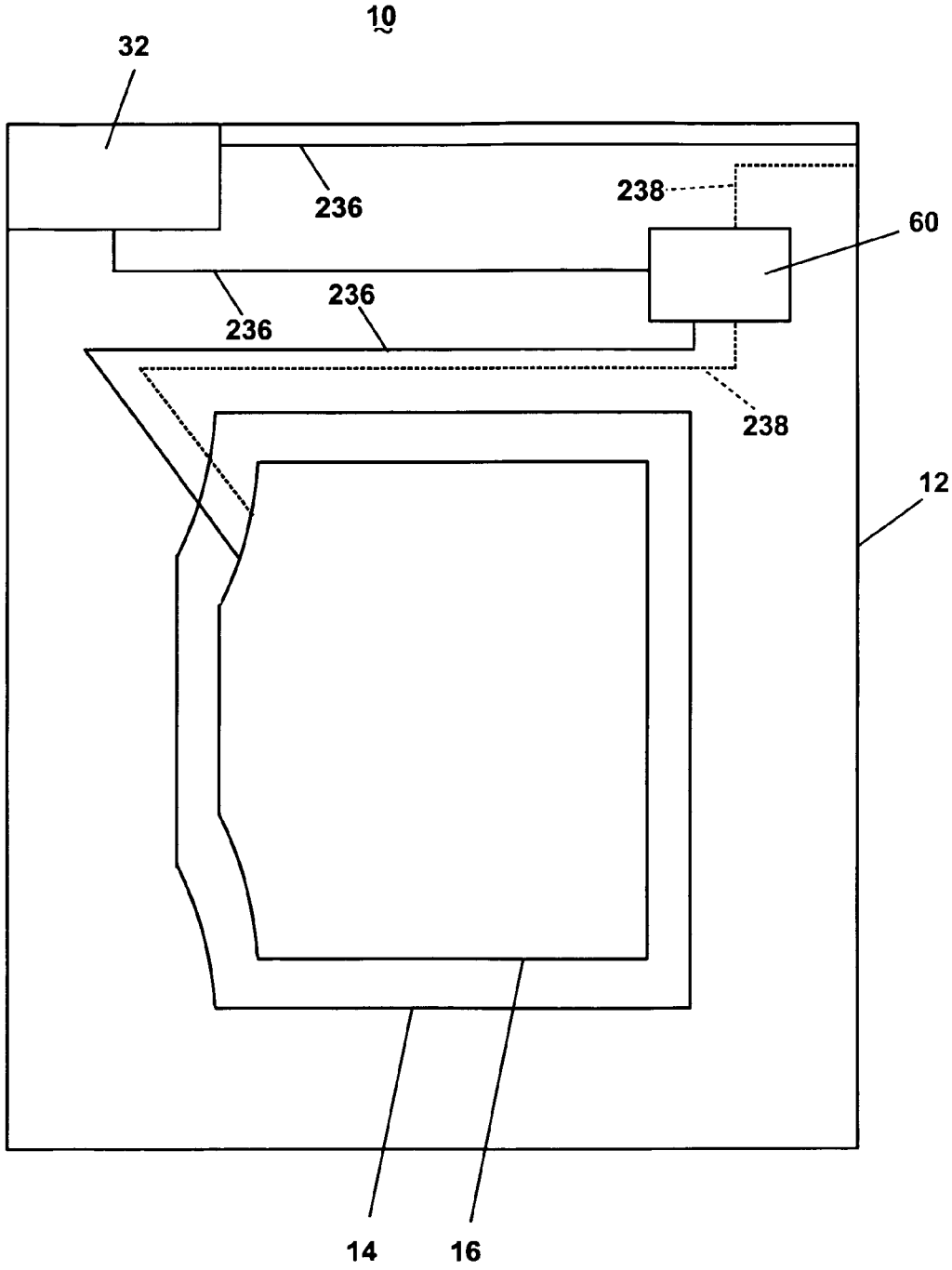
FIG. 17 is a schematic view of the washing machine of FIG. 1 with alternative structures for introducing liquid into the steam generator of the washing machine and for introducing steam into the drum of the washing machine according to one embodiment of the invention.

Alternative structures for introducing liquid into the steam generator 60 are illustrated schematically in FIGS. 16 and 17. Referring particularly to FIG. 16, the liquid can be supplied from the external source and through the detergent dispenser 32 to the steam generator 60, as shown by a solid line 236, or directly from the external source to the steam generator 60, as shown by a dotted line 238. The steam created by the steam generator 60 from the liquid can be supplied to the tub 14, as shown by either the solid line 236 or the dotted line 238. The inlet for supplying the steam to the tub 14 can be positioned in any suitable location and is illustrated as along an upper wall of the tub 14 in FIG. 16 for exemplary purposes. Alternatively, the steam can be supplied directly to the drum 16 rather than to the tub 14, as depicted in FIG. 17. The inlet for supplying the steam to the drum 16 can be positioned in any suitable location and is illustrated as along a front wall of the drum 16 in FIG. 17 for exemplary purposes.

Figure 18:
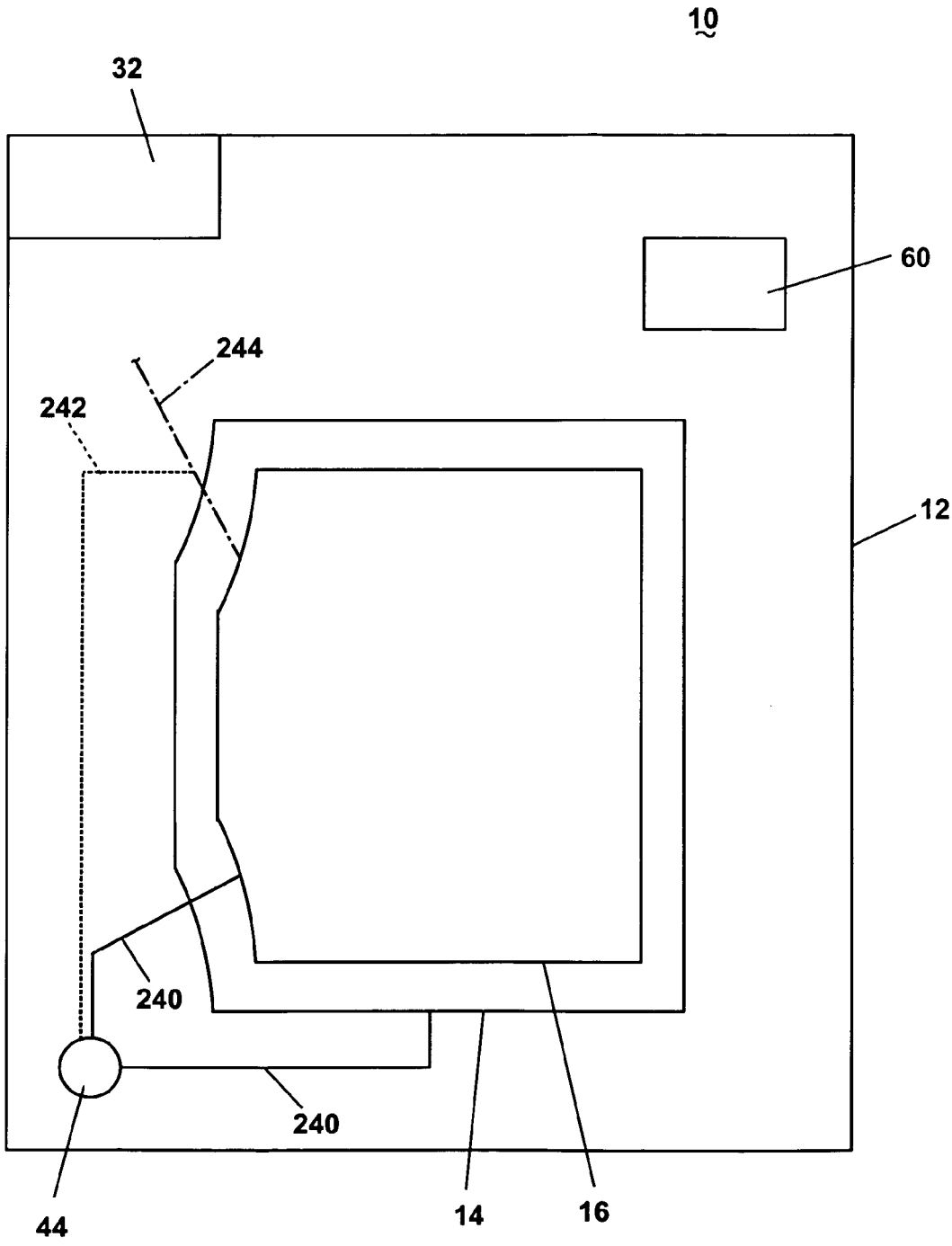
FIG. 18 is a schematic view of the washing machine of FIG. 1 with alternative structures for recirculating liquid from the tub to the drum of the washing machine according to one embodiment of the invention.

Alternative structures for recirculating liquid from the tub 14 to the drum 16 are illustrated schematically in FIG. 18. The liquid from the tub 14 flows to the pump 44, which can direct the liquid to a dedicated recirculation inlet that supplies the liquid to the drum 16, as shown by a solid line 240, or to a conduit, as shown by a dotted line 242, which connects with a shared inlet to the drum 16, as indicated by a dash-dot-dash line 244. The shared inlet can be an inlet for introducing liquid and/or steam into the drum 16. The shared inlet can be coupled with the detergent dispenser 32 and/or the steam generator 60. The dedicated inlet and the shared inlet for supplying the recirculated liquid to the drum 16 can be positioned in any suitable location and are illustrated as along a front wall of the drum 16 in FIG. 18 for exemplary purposes.

Figure 19:
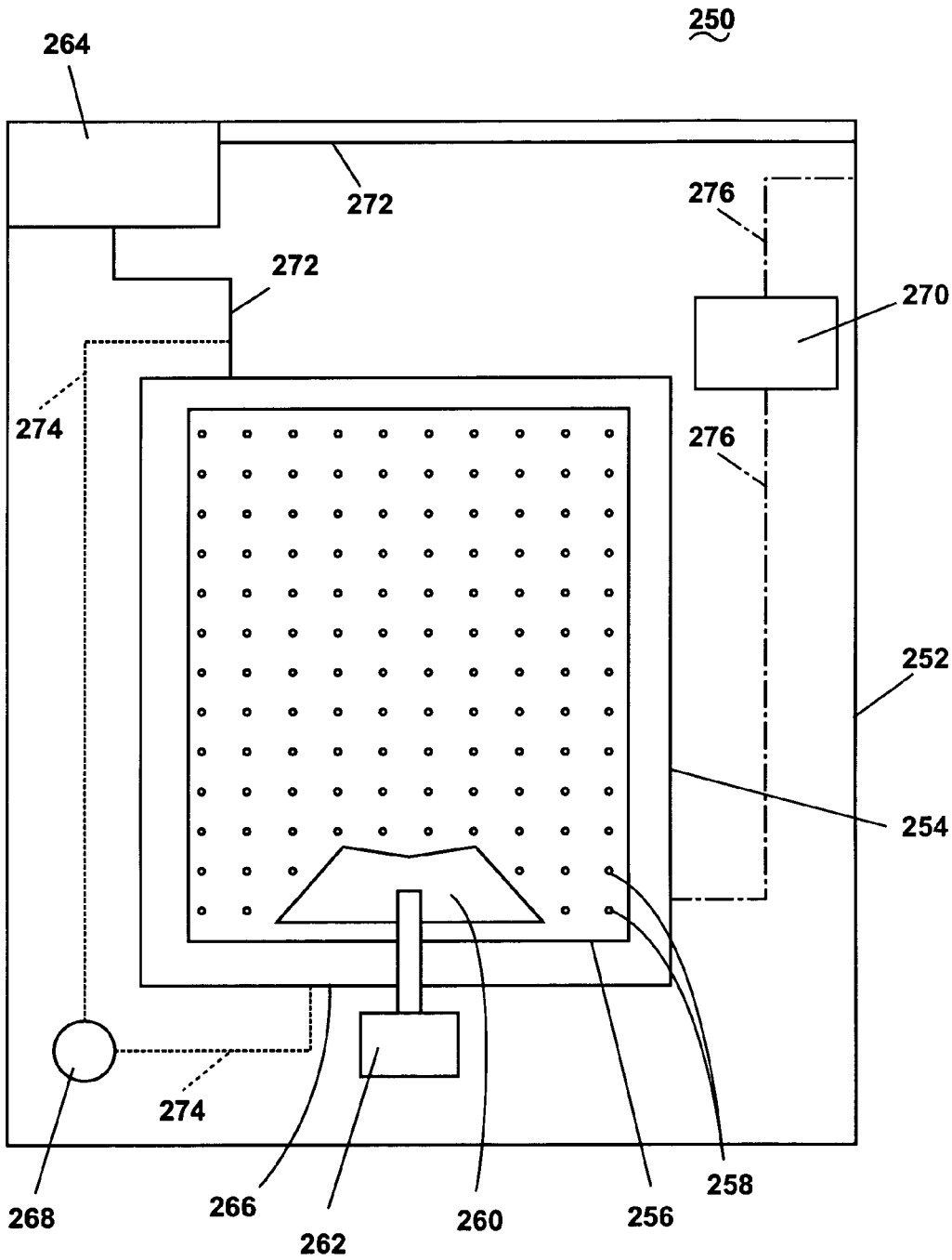
FIG. 19 is a schematic view of a vertical axis steam washing machine according to one embodiment of the invention.

The method 100, 100' can also be employed with a vertical axis washing machine. FIG. 19 presents a schematic view of an exemplary vertical axis washing machine 250. The washing machine 250 comprises a cabinet 252 that houses a stationary tub 254. A rotatable drum 256 mounted within the tub 254 includes a plurality of perforations 258, and liquid can flow between the tub 254 and the drum 256 through the perforations 258. The washing machine 250 further comprises a fabric movement element 260, such as an agitator, impeller, nutator, and the like, that induces movement of fabric items contained in the drum 256. A motor 262 coupled to the drum 256 and to the fabric movement element 260 induces rotation of the drum 256 and the fabric movement element 260. The drum 256 and the fabric movement element 260 can be rotated individually, simultaneously, in one direction, or in opposite directions.

The washing machine 250 of FIG. 19 further comprises a liquid supply and recirculation system. Liquid can be supplied to the tub 254 and/or drum 256 through a detergent dispenser 264, as indicated by a solid line 272 in FIG. 19. The liquid can also be recirculated from a sump 266 to the drum 256 via a pump 268, as indicated by a dotted line 274. The pump 268 can also be used to drain the liquid from the sump 266 to a location external to the washing machine 250. The washing machine 250 further includes a steam generation system. The steam generation system comprises a steam generator 270 that receives liquid and coverts the liquid to steam, which is introduced to the tub 254 and/or drum 256, as shown by a dash-dot-dash line 276. The vertical axis washing machine 250 is provided for illustrative purposes only, and it is within the scope of the invention to utilize other types of vertical axis steam washing machines.

Other structures and methods related to steam washing machines are disclosed in the following patent applications, which are incorporated herein by reference in their entirety: our Ser. No. 11/450,636, now U.S. Pat. No. 7,627,920, issued Dec. 8, 2009, titled "Method of Operating a Washing Machine Using Steam," and filed concurrently herewith; and our Ser. No. 11/450,529, now U.S. Pat. No. 7,765,628, issued Aug. 3, 2010, titled "Steam Washing Machine Operation Method Having Dual Speed Spin Pre-Wash," and filed concurrently herewith.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of operating a horizontal axis washing machine having a tub with a drum having an interior surface mounted in the tub for rotation about a horizontal axis and configured to hold a fabric load, the method comprising:

distributing an unwetted fabric load by rotating the drum about the horizontal axis at a spin speed to generate a force greater than or equal to 1G acting on the fabric load to distribute the unwetted fabric load about the interior surface of the drum prior to wetting the unwetted fabric load with a detergent solution; and after the distributing of the unwetted fabric load and while the drum is rotating at the spin speed, wetting the unwetted fabric load by introducing and recirculating a detergent solution into the drum at least until the fabric load is saturated with the detergent solution.

2. The method according to claim 1, further comprising rotating the drum at a tumble speed after the rotating the drum at the spin speed.

3. The method according to claim 1, wherein the recirculating comprises recirculating the detergent solution between the tub and the drum.

4. The method according to claim 3, wherein the introducing of detergent solution comprises adding liquid to at least one of the tub and the drum to compensate for liquid absorbed by the fabric load.

5. The method according to claim 4, wherein the adding, recirculating, and rotating the drum at the spin speed repeats until a ratio of fabric load weight to liquid weight reaches a predetermined ratio.

6. The method according to claim 1 wherein the introducing and recirculating the detergent solution continues until a ratio of fabric load weight to liquid load weight reaches a predetermined ratio in a range of about 1:0.5 to 1:2.7.

7. The method according to claim 1, further comprising introducing steam into at least one of the tub and the drum.

8. The method according to claim 7, wherein the introducing of the steam occurs after the introducing of the detergent solution and the rotating the drum at the spin speed.

9. The method according to claim 7, further comprising rotating the drum during the introducing of the steam.

10. The method according to claim 9, wherein the rotating of the drum during the introducing of the steam comprises rotating the drum at a tumble speed.

11. The method according to claim 1, wherein the introducing and rotating the drum at the spin speed are part of a pre-wash step, and a washing step follows the pre-wash step.

12. The method according to claim 11, wherein a ratio of fabric load weight to liquid weight is greater during the pre-wash step than during the washing step.

13. The method according to claim 11, further comprising introducing steam into at least one of the tub and the drum at least one of during the pre-wash step, between the pre-wash step and the washing step, and during the washing step.

14. The method according to claim 13, further comprising a rinsing step and an extraction step following the washing step.

15. The method according to claim 6, wherein the predetermined ratio is in a range of about 1:1 and 1:2.

* * * * *